US009318041B2

(12) United States Patent
Kawabata et al.

(10) Patent No.: US 9,318,041 B2
(45) **Date of Patent: *Apr. 19, 2016**

(54) LIQUID CRYSTAL DISPLAY DEVICE, TELEVISION RECEIVER, AND DISPLAY METHOD FOR LIQUID CRYSTAL DISPLAY DEVICE

(71) Applicant: Sharp Kabushiki Kaisha, Osaka (JP)

(72) Inventors: Masae Kawabata, Osaka (JP); Fumikazu Shimoshikiryoh, Osaka (JP); Kentaroh Irie, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/604,585

(22) Filed: Jan. 23, 2015

(65) Prior Publication Data

US 2015/0130694 A1 May 14, 2015

Related U.S. Application Data

(62) Division of application No. 13/511,972, filed as application No. PCT/JP2010/065342 on Sep. 7, 2010, now Pat. No. 8,976,096.

(30) Foreign Application Priority Data

Nov. 27, 2009 (JP) ..... 2009-270813

(51) Int. Cl.
*G09G 3/36* (2006.01)
*G09G 3/20* (2006.01)

(52) U.S. Cl.
CPC ..... *G09G 3/2018* (2013.01); *G09G 3/2022* (2013.01); *G09G 3/2074* (2013.01); *G09G 3/36* (2013.01); *G09G 3/3607* (2013.01);

(Continued)

(58) Field of Classification Search
USPC ..... 345/590, 596, 89, 87, 98, 63, 92, 94, 345/212, 204, 690, 694
See application file for complete search history.

(56) References Cited

U.S. PATENT DOCUMENTS 5,479,188 A 12/1995 Moriyama
5,847,688 A 12/1998 Ohi et al.

(Continued)

FOREIGN PATENT DOCUMENTS

JP 5-210356 A 8/1993
JP 6-347758 A 12/1994

(Continued)

*Primary Examiner* — Thuy Pardo
(74) *Attorney, Agent, or Firm* — Chen Yoshimura LLP

(57) ABSTRACT

A liquid crystal display device includes a liquid crystal panel having a plurality of pixels grouped into four types of type 1, type 2, type 3, and type 4; a panel driver circuit connected to the liquid crystal panel to drive the liquid crystal panel; and a display control circuit connected to the panel driver circuit, wherein said display control circuit divides each refresh cycle of the image signal into consecutive first to fourth terms and causes the panel driver circuit to drive the liquid crystal panel to perform a halftone display by changing pixel luminance during each refresh cycle composed of the first to fourth terms, and wherein said display control circuit provides timing signals and gradation data to the panel driver circuit so that, for a given halftone to be displayed in a refresh cycle, pixels belonging to respective types in the liquid crystal panel are driven such that the halftone is generated as averaged over the first to fourth terms.

14 Claims, 24 Drawing Sheets

(52) U.S. Cl.
CPC ..... *G09G2300/0439* (2013.01); *G09G 2300/0443* (2013.01); *G09G 2300/0478* (2013.01); *G09G 2320/0247* (2013.01); *G09G 2320/0285* (2013.01)

(56) References Cited

U.S. PATENT DOCUMENTS

| | | | | |
|---|---|---|---|---|
| 6,072,451 | A | 6/2000 | Mano et al. | |
| 6,229,515 | B1 * | 5/2001 | Itoh | G09G 3/3648 345/100 |
| 6,466,225 | B1 * | 10/2002 | Larkin | G09G 3/36 345/596 |
| 6,614,413 | B2 | 9/2003 | Tokunaga et al. | |
| 2003/0058211 | A1 | 3/2003 | Kim et al. | |
| 2005/0017991 | A1 | 1/2005 | Yamazaki et al. | |
| 2005/0219188 | A1 | 10/2005 | Kawabe et al. | |
| 2007/0013633 | A1 | 1/2007 | Kamada et al. | |
| 2007/0132674 | A1 | 6/2007 | Tsuge | |
| 2008/0284768 | A1 * | 11/2008 | Yoshida | G09G 3/2022 345/208 |
| 2010/0090938 | A1 | 4/2010 | Kamada et al. | |
| 2010/0103206 | A1 | 4/2010 | Kamada et al. | |
| 2010/0149227 | A1 * | 6/2010 | Tomizawa | G09G 3/3648 345/694 |

FOREIGN PATENT DOCUMENTS

| | | | |
|---|---|---|---|
| JP | H07-121144 | A | 5/1995 |
| JP | 2000-231368 | A | 8/2000 |
| JP | 2003-99017 | A | 4/2003 |
| JP | 2004-302270 | A | 10/2004 |
| JP | 2004-334153 | A | 11/2004 |
| JP | 2006-184516 | A | 7/2006 |
| JP | 2007-171413 | A | 7/2007 |
| JP | 2008-197349 | A | 8/2008 |
| JP | 2009-20197 | A | 1/2009 |

* cited by examiner

FIG. 4

| Input gradation | Output (LUT1) | Output (LUT2) |
|---|---|---|
| 0 | 0 | 0 |
| 1 | 1 | 0 |
| 2 | 3 | 0 |
| 3 | 6 | 0 |
| 4 | 9 | 0 |
| 5 | 17 | 0 |
| 6 | 28 | 0 |
| 7 | 40 | 0 |
| 8 | 47 | 0 |
| 9 | 54 | 0 |
| 10 | 59 | 0 |
| 11 | 64 | 0 |
| 12 | 69 | 0 |
| 13 | 73 | 0 |
| 14 | 77 | 0 |
| 15 | 80 | 0 |
| 16 | 82 | 0 |
| 17 | 85 | 0 |
| 18 | 87 | 0 |
| 19 | 89 | 0 |
| 20 | 91 | 0 |
| 21 | 93 | 0 |
| 22 | 95 | 0 |
| 23 | 96 | 0 |
| 24 | 98 | 0 |
| 25 | 100 | 0 |
| 26 | 101 | 0 |
| 27 | 102 | 0 |
| 28 | 103 | 0 |
| 29 | 105 | 0 |
| 30 | 106 | 0 |
| 31 | 107 | 0 |
| 32 | 109 | 0 |
| 33 | 110 | 0 |
| 34 | 111 | 0 |
| 35 | 112 | 0 |
| 36 | 113 | 0 |
| 37 | 114 | 0 |
| 38 | 115 | 0 |
| 39 | 116 | 0 |
| 40 | 117 | 0 |
| 41 | 118 | 0 |
| 42 | 119 | 0 |
| 43 | 120 | 0 |
| 44 | 121 | 0 |
| 45 | 122 | 0 |
| 46 | 123 | 0 |
| 47 | 124 | 0 |
| 48 | 126 | 0 |
| 49 | 127 | 0 |
| 50 | 128 | 0 |
| 51 | 129 | 0 |
| 52 | 130 | 0 |
| 53 | 132 | 0 |
| 54 | 133 | 0 |
| 55 | 135 | 0 |
| 56 | 136 | 0 |
| 57 | 137 | 0 |

| Input gradation | Output (LUT1) | Output (LUT2) |
|---|---|---|
| 58 | 138 | 0 |
| 59 | 140 | 0 |
| 60 | 141 | 0 |
| 61 | 142 | 0 |
| 62 | 144 | 0 |
| 63 | 145 | 0 |
| 64 | 146 | 0 |
| 65 | 148 | 0 |
| 66 | 149 | 0 |
| 67 | 151 | 0 |
| 68 | 152 | 0 |
| 69 | 154 | 0 |
| 70 | 155 | 0 |
| 71 | 157 | 0 |
| 72 | 158 | 0 |
| 73 | 160 | 0 |
| 74 | 161 | 0 |
| 75 | 163 | 0 |
| 76 | 164 | 0 |
| 77 | 165 | 0 |
| 78 | 167 | 0 |
| 79 | 168 | 0 |
| 80 | 170 | 0 |
| 81 | 171 | 0 |
| 82 | 172 | 0 |
| 83 | 174 | 0 |
| 84 | 175 | 0 |
| 85 | 177 | 0 |
| 86 | 178 | 0 |
| 87 | 180 | 0 |
| 88 | 181 | 0 |
| 89 | 182 | 0 |
| 90 | 183 | 0 |
| 91 | 185 | 0 |
| 92 | 186 | 0 |
| 93 | 188 | 0 |
| 94 | 189 | 0 |
| 95 | 190 | 0 |
| 96 | 191 | 0 |
| 97 | 192 | 0 |
| 98 | 193 | 0 |
| 99 | 195 | 0 |
| 100 | 195 | 0 |
| 101 | 197 | 0 |
| 102 | 198 | 0 |
| 103 | 199 | 0 |
| 104 | 200 | 0 |
| 105 | 200 | 0 |
| 106 | 202 | 0 |
| 107 | 203 | 0 |
| 108 | 203 | 0 |
| 109 | 204 | 0 |
| 110 | 205 | 0 |
| 111 | 206 | 0 |
| 112 | 206 | 0 |
| 113 | 207 | 0 |
| 114 | 208 | 0 |
| 115 | 209 | 0 |

| Input gradation | Output (LUT1) | Output (LUT2) |
|---|---|---|
| 116 | 210 | 0 |
| 117 | 211 | 0 |
| 118 | 211 | 0 |
| 119 | 212 | 0 |
| 120 | 213 | 0 |
| 121 | 214 | 0 |
| 122 | 215 | 0 |
| 123 | 215 | 0 |
| 124 | 216 | 0 |
| 125 | 216 | 0 |
| 126 | 218 | 0 |
| 127 | 218 | 0 |
| 128 | 219 | 0 |
| 129 | 220 | 0 |
| 130 | 220 | 0 |
| 131 | 221 | 0 |
| 132 | 222 | 0 |
| 133 | 222 | 0 |
| 134 | 223 | 0 |
| 135 | 224 | 0 |
| 136 | 225 | 0 |
| 137 | 225 | 0 |
| 138 | 226 | 0 |
| 139 | 227 | 0 |
| 140 | 228 | 0 |
| 141 | 228 | 0 |
| 142 | 229 | 0 |
| 143 | 229 | 0 |
| 144 | 230 | 0 |
| 145 | 230 | 0 |
| 146 | 232 | 0 |
| 147 | 232 | 0 |
| 148 | 233 | 0 |
| 149 | 233 | 0 |
| 150 | 234 | 0 |
| 151 | 234 | 0 |
| 152 | 235 | 0 |
| 153 | 235 | 0 |
| 154 | 236 | 0 |
| 155 | 237 | 0 |
| 156 | 237 | 0 |
| 157 | 238 | 0 |
| 158 | 239 | 0 |
| 159 | 239 | 0 |
| 160 | 240 | 0 |
| 161 | 240 | 0 |
| 162 | 241 | 0 |
| 163 | 242 | 0 |
| 164 | 243 | 0 |
| 165 | 243 | 0 |
| 166 | 244 | 0 |
| 167 | 244 | 0 |
| 168 | 245 | 0 |
| 169 | 245 | 0 |
| 170 | 246 | 0 |
| 171 | 247 | 0 |
| 172 | 248 | 0 |

FIG. 5

| Input gradation | Output (LUT1) | Output (LUT2) |
|---|---|---|
| 173 | 248 | 0 |
| 174 | 250 | 0 |
| 175 | 252 | 0 |
| 176 | 254 | 0 |
| 177 | 255 | 1 |
| 178 | 255 | 1 |
| 179 | 255 | 2 |
| 180 | 255 | 2 |
| 181 | 255 | 2 |
| 182 | 255 | 3 |
| 183 | 255 | 3 |
| 184 | 255 | 3 |
| 185 | 255 | 3 |
| 186 | 255 | 3 |
| 187 | 255 | 4 |
| 188 | 255 | 4 |
| 189 | 255 | 5 |
| 190 | 255 | 5 |
| 191 | 255 | 6 |
| 192 | 255 | 7 |
| 193 | 255 | 8 |
| 194 | 255 | 8 |
| 195 | 255 | 10 |
| 196 | 255 | 12 |
| 197 | 255 | 18 |
| 198 | 255 | 25 |
| 199 | 255 | 31 |
| 200 | 255 | 38 |
| 201 | 255 | 45 |
| 202 | 255 | 52 |
| 203 | 255 | 59 |
| 204 | 255 | 65 |
| 205 | 255 | 70 |
| 206 | 255 | 76 |
| 207 | 255 | 81 |
| 208 | 255 | 86 |
| 209 | 255 | 91 |
| 210 | 255 | 95 |
| 211 | 255 | 100 |
| 212 | 255 | 103 |
| 213 | 255 | 108 |
| 214 | 255 | 112 |
| 215 | 255 | 116 |
| 216 | 255 | 119 |
| 217 | 255 | 123 |
| 218 | 255 | 127 |
| 219 | 255 | 132 |
| 220 | 255 | 136 |
| 221 | 255 | 141 |
| 222 | 255 | 145 |
| 223 | 255 | 150 |
| 224 | 255 | 154 |
| 225 | 255 | 158 |
| 226 | 255 | 161 |
| 227 | 255 | 166 |
| 228 | 255 | 170 |
| 229 | 255 | 175 |
| 230 | 255 | 179 |

| Input gradation | Output (LUT1) | Output (LUT2) |
|---|---|---|
| 231 | 255 | 183 |
| 232 | 255 | 186 |
| 233 | 255 | 190 |
| 234 | 255 | 194 |
| 235 | 255 | 198 |
| 236 | 255 | 202 |
| 237 | 255 | 206 |
| 238 | 255 | 209 |
| 239 | 255 | 213 |
| 240 | 255 | 216 |
| 241 | 255 | 219 |
| 242 | 255 | 223 |
| 243 | 255 | 226 |
| 244 | 255 | 229 |
| 245 | 255 | 231 |
| 246 | 255 | 234 |
| 247 | 255 | 237 |
| 248 | 255 | 239 |
| 249 | 255 | 242 |
| 250 | 255 | 244 |
| 251 | 255 | 246 |
| 252 | 255 | 249 |
| 253 | 255 | 250 |
| 254 | 255 | 253 |
| 255 | 255 | 255 |

(a)

1H later (b)

(a)

(b)

(c)

(d)

LIQUID CRYSTAL DISPLAY DEVICE, TELEVISION RECEIVER, AND DISPLAY METHOD FOR LIQUID CRYSTAL DISPLAY DEVICE

TECHNICAL FIELD

The present invention relates to a display device that displays a halftone by changing the luminance of pixels over time.

BACKGROUND ART

A technology that displays a halftone by changing the luminance of pixels over time and thus improves the viewing angle characteristics of the liquid crystal display has been proposed. Patent Document 1, for example, discloses a display technology of a liquid crystal display device where display units, each composed of an R pixel, a G pixel, and a B pixel arranged in a row direction, are disposed in a matrix. In this technology, four frames constitute one cycle, and the pixel belonging to a display unit located at the jth position in the ith row or at the (j+1)th position in the (i+1)th row display bright during the first frame F1 displays bright during the second frame F2, displays dark during the third frame F3, and displays dark during the fourth frame F4. On the other hand, the pixel belonging to a display unit located at the (j+1)th position in the ith row or located at the jth position in the (i+1)th row displays dark during the first frame F1, displays dark during the second frame F2, displays bright during the third frame F3, and displays bright during the fourth frame F4.

RELATED ART DOCUMENTS

Patent Documents

Patent Document 1: Japanese Patent Application Laid-Open Publication No. H7-121144 (published on May 12, 1995)

Patent Document 2: Japanese Patent Application Laid-Open Publication No. 2006-184516 (published on Jul. 13, 2006)

Patent Document 3: Japanese Patent Application Laid-Open Publication No. 2004-302270 (published on Oct. 28, 2004)

SUMMARY OF THE INVENTION

Problems to be Solved by the Invention

However, according to the configuration disclosed in Patent Document 1, the fluctuation in luminance as shown in FIG. 24(*a*) occurs at the pixel belonging to the display unit located at the jth position in the ith row, and the fluctuation in luminance as shown in FIG. 24(*b*) occurs at the pixel belonging to the display unit located at the (j+1)th position in the ith row, the fluctuation in luminance as shown in FIG. 24(*c*) occurs at the pixel belonging to the display unit located at the jth position in the (i+1)th row, and the fluctuation in luminance as shown in FIG. 24(*d*) occurs at the pixel belonging to the display unit located at the (j+1)th position in the (i+1)th row. The fluctuation in luminance falls in two patterns (phases). As a result, as shown in FIG. 24(*e*), the display flickering occurs at every two frames. That is, even if the frame frequency is 120 Hz (so-called double-speed driving), the flicker frequency is 60 Hz, which is within the human recognition range (lower than 75 Hz, in general).

The present invention aims at improving the viewing angle characteristics of the liquid crystal display device and reducing the flickering at the same time.

Means for Solving the Problems

The present liquid crystal display device performs a halftone display by changing pixel luminance throughout a cycle composed of first to fourth terms, and includes: a type 1 pixel that rises during a first term, rises or stays on hold during a second term, decays during a third term, and decays or stays on hold during a fourth term to continuously display one halftone; a type 2 pixel that decays during the first term, decays or stays on hold during the second term, rises during the third term, and rises or stays on hold during the fourth term to continuously display one halftone; a type 3 pixel that rises or stays on hold during the first term, decays during the second term, decays or stays on hold during the third term, and rises during the fourth term to continuously display one halftone; and a type 4 pixel that decays or stays on hold during the first term, rises during the second term, rises or stays on hold during the third term, and decays during the fourth term to continuously display one halftone, where "rises" means that the luminance increases during the term, "decays" means that the luminance decreases during the term, and "stays on hold" means that the same luminance is maintained during the term.

As described above, by having four types of pixels (type 1 to type 4) whose luminance variation patterns during a cycle are different from each other when displaying the same halftone continuously, the total luminance of type 1 to type 4 pixels becomes uniform temporally, and the total luminance change cycle becomes shorter. That is, the present display device displays each halftone by changing the luminance of pixels, which improves the viewing angle characteristics, increases the frequency of the display flickering, and decreases the magnitude of the flickering (amplitude of the flickering). Here, one frame period of a pixel is defined as the time elapsed after the pixel is charged (written) and before the same pixel is charged (written) the next time, and a term is defined as at least a one-frame period (such as a one-frame period or a two-frame period).

The present liquid crystal display device may have a configuration in which a cycle is a four-frame period and each term is a one-frame period, or a cycle is an eight-frame period and each term is a two-frame period.

The present liquid crystal display device may also be configured such that: on the type 1 pixel, an effective voltage that is at least as high as a first voltage is applied during the first and second terms, while an effective voltage lower than the first voltage is applied during the third and fourth terms; on the type 2 pixel; an effective voltage lower than a second voltage is applied during the first and second terms, while an effective voltage that is at least as high as the second voltage is applied during the third and fourth terms; on the type 3 pixel, an effective voltage lower than a third voltage is applied during the second and third terms, while an effective voltage that is at least as high as the third voltage is applied during at least either the first term or the fourth term; on the type 4 pixel; and an effective voltage that is at least as high as a fourth voltage is applied during each of the second and third frame periods, while an effective voltage lower than the fourth voltage is applied during at least either the first term or the fourth term.

The present liquid crystal display device may also be configured such that display units, each of which is composed of a plurality of pixels of different colors, are arranged in the row and column directions, and the plurality of pixels included in each display unit are of the same type.

The present liquid crystal display device may be configured such that two pixels disposed adjacent to each other in the scan direction are of different types.

The present liquid crystal display device may also be configured such that two pixels arranged in the scan direction with another pixel disposed in between are of the same type.

The present liquid crystal display device may also be configured such that, when the scan direction is the column direction, a display unit composed of type 1 pixels and a display unit composed of type 3 pixels are disposed adjacent to each other in the row direction; a display unit composed of type 3 pixels and a display unit composed of type 2 pixels are disposed adjacent to each other in the row direction; a display unit composed of type 2 pixels and a display unit composed of type 4 pixels are disposed adjacent to each other in the row direction; and a display unit composed of type 4 pixels and a display unit composed of type 1 pixels are disposed adjacent to each other in the row direction.

The present liquid crystal display device may also be configured such that a display unit composed of type 1 pixels and a display unit composed of type 2 pixels are disposed adjacent to each other in the column direction; and a display unit composed of type 3 pixels and a display unit composed of type 4 pixels are disposed adjacent to each other in the column direction.

The present liquid crystal display device may also be configured such that each display unit is composed of a red pixel, a green pixel, and a blue pixel.

The present liquid crystal display device may also be configured such that a total number of display units composed of type 1 pixels, a total number of display units composed of type 2 pixels, and a total number of display units composed of type 3 pixels, and a total number of display units composed of type 4 pixels are substantially equal.

The present liquid crystal display device may also be configured such that the frame frequency is at least 75 Hz.

The present liquid crystal display may also be configured such that, when the scan direction is the column direction, two data signal lines are provided for each column of pixels, two pixels disposed adjacent to each other in the column direction are connected to respective data signal lines through transistors, and two scan signal lines are selected at a time.

The present liquid crystal display device may also be configured such that two data lines provided for each column of pixels receive respective signal potentials, which are of opposite polarities.

The present liquid crystal display device may also be configured such that writing to each of the n pixels (n is an integer of at least 3) is conducted one frame period after any previous writing to the same pixel, and that, with one term composed of a single frame or a plurality of frames and one cycle composed of a first to nth terms, luminance levels of the individual n pixels change differently from one another during each of the first to the nth terms when data that corresponds to a halftone and sets the average luminance in a cycle of each of the n pixels to an equal level is continuously displayed.

The present television receiver includes the above-mentioned liquid crystal display device and a tuner unit receiving the television broadcasting.

The present liquid crystal display device displays a halftone by changing the luminance of pixels during a cycle composed of the first to fourth terms, wherein the type 1 pixel rises during the first term, rises or stays on hold during the second term, decays during the third term, and decays or stay on hold during the fourth term to continuously display one halftone; the type 2 pixel decays during the first time, decays or stays on hold during the second term, rises during the third term, and rises or stays on hold during the fourth term to continuously display one halftone; the type 3 pixel rises or stays on hold during the first term, decays during the second term, decays or stays on hold during the third term, and rises during the fourth term to continuously display one halftone; and the type 4 pixel decays or stays on hold during the first term, rises during the second term, rises or stays on hold during the third term, and decays during the fourth term to continuously display one halftone, where "rises" means that the luminance of the pixel increases during the term, "decays" means that the luminance of the pixel decreases during the term, and "stays on hold" means that a same luminance of the pixel is maintained during the term.

Effects of the Invention

The present liquid crystal display device can increase the display flicker frequency and reduce the magnitude of the flicker (amplitude of the flicker) while improving the viewing angle characteristics.

BRIEF DESCRIPTION OF THE DRAWINGS

FIG. 4 is a table showing an example of LUT 1 and LUT 2 used in the present liquid crystal display device (gradations 0 to 172).

FIG. 5 is a table showing an example of LUT 1 and LUT 2 used in the present liquid crystal display device (gradations 173 to 255).

FIG. 7 is conducted.

FIG. 12 is conducted.

DETAILED DESCRIPTION OF EMBODIMENTS

Figure 1:
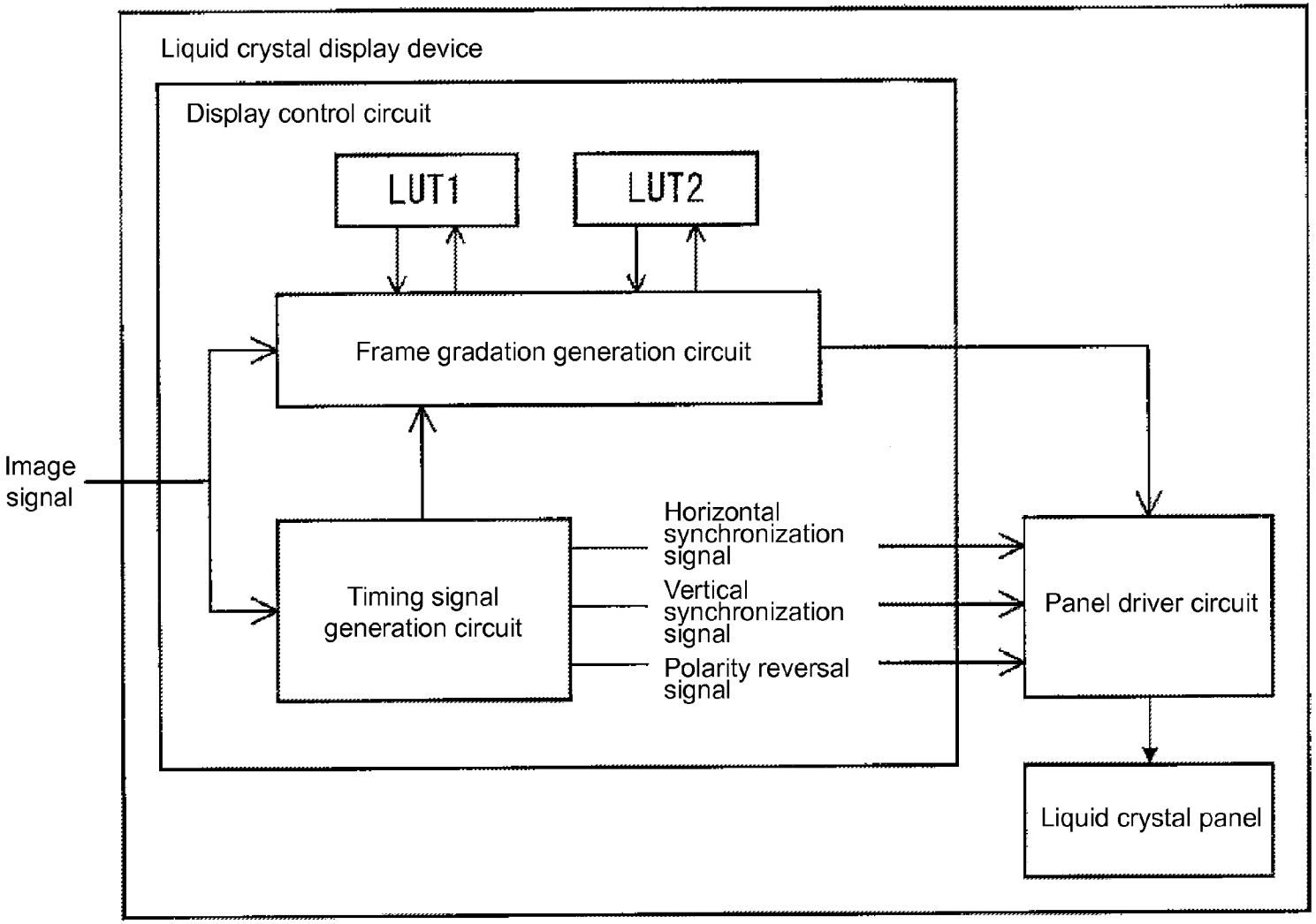
FIG. 1 is a block diagram showing a configuration of the present liquid crystal display device.
Figure 2:
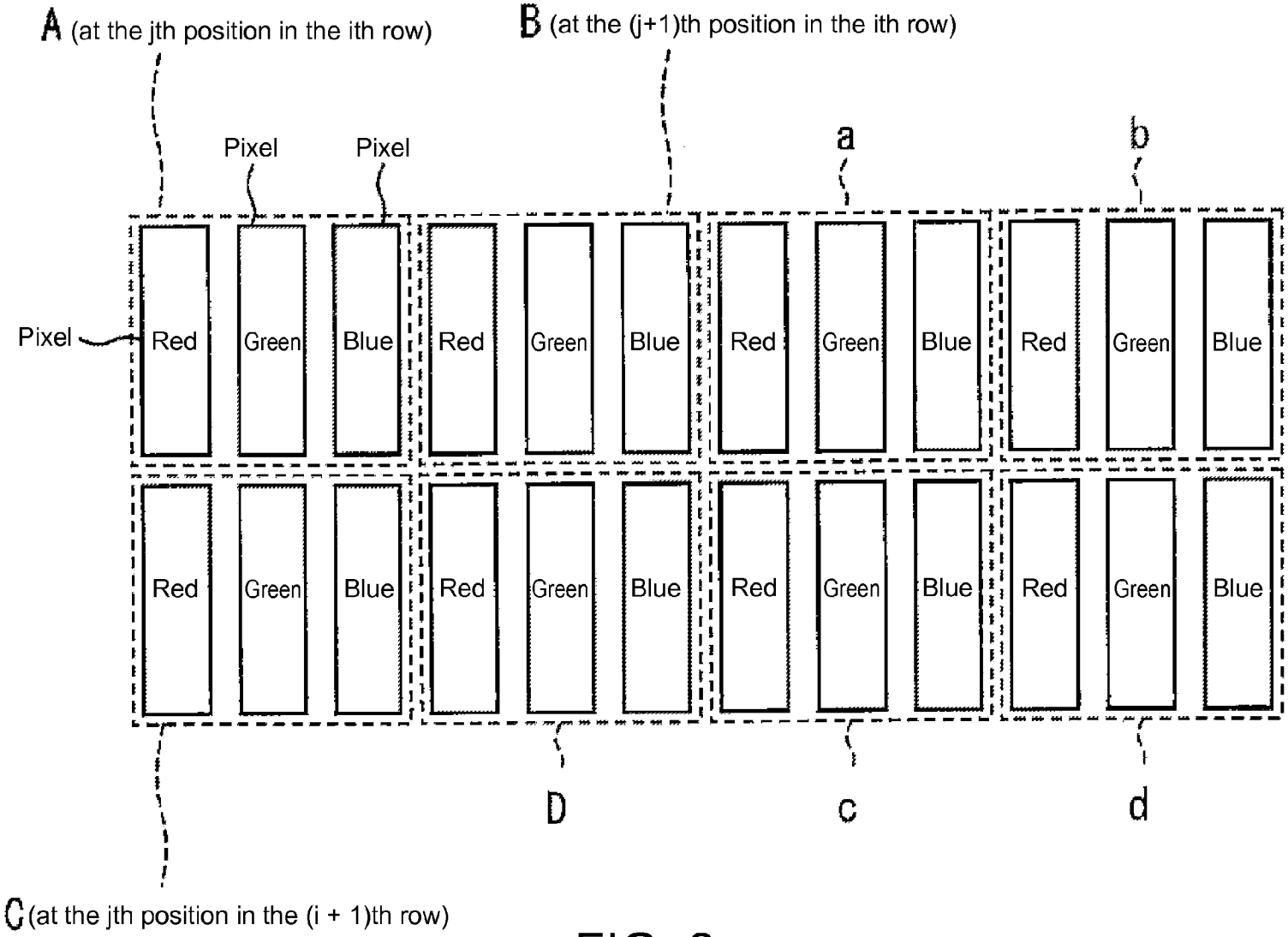
FIG. 2 schematically shows the arrangement of 24 pixels belonging to eight display units (A to D and a to d) of a liquid crystal panel.

Embodiments of the present invention are described with reference to FIGS. 1 to 23 as follows. FIG. 1 is a block diagram showing a configuration of the present liquid crystal display device. As shown in the figure, the liquid crystal display device displays a halftone by changing the luminance of pixels during a cycle composed of the first to the fourth terms. The liquid crystal display device includes a liquid crystal panel, a panel driver circuit, and a display control circuit. The liquid crystal panel includes a plurality of scan signal lines, a plurality of data signal lines, and a plurality of display units arranged in the row direction (the direction perpendicular to the scan direction) and the column direction (scan direction). As shown in FIG. 2, each display unit is composed of an R pixel, a G pixel, and a B pixel disposed in the row direction. In the following description, the display unit at the jth position in the ith row is display unit A, the display unit at the (j+1)th position in the ith row is display unit B, the display unit at the jth position in the (i+1)th row is display unit c, the display unit at the (j+1)th position in the (i+1)th row is display unit D, the display unit at the (j+2)th position in the ith row is display unit a, the display unit at the (j+3)th position in the ith row is display unit b, the display unit at the (j+2)th position in the (i+1)th row is display unit c, and the display unit at the (j+3)th position in the (i+1)th row is display unit d. The panel driver circuit includes a source driver that drives the data signal lines, and a gate driver that drives the scan signal lines. The display control circuit includes a timing signal generation circuit, a frame gradation generation circuit, a LUT (Look-Up Table) 1, and a LUT (Look-Up Table) 2.

The timing signal generation circuit generates a horizontal synchronization signal, a vertical synchronization signal, and a polarity reversal signal based on the image signal inputted, and inputs them to the panel driver circuit.

The frame gradation generation circuit generates the frame gradation data corresponding to the gradation data indicated by the inputted image signal (hereinafter abbreviated as "frame gradation") using LUT 1 and LUT 2.

For example, when a cycle is composed of four frames (one gradation is displayed by changing the luminance of the pixels during a cycle composed of the first to the fourth frame periods), four frame gradations are generated for each inputted gradation. That is, if the inputted gradation is a halftone, the first to fourth frame gradations of type 1 that satisfy the relation of the first frame gradation=second frame gradation>inputted gradation>third frame gradation=fourth frame gradation; the first to fourth frame gradations of type 2 that satisfy the relation of the first frame gradation=second frame gradation<inputted gradation<third frame gradation=fourth frame gradation; the first to fourth frame gradations of type 3 that satisfy the relation of the first frame gradation=fourth frame gradation>inputted gradation>second frame gradation=third frame gradation; or the first to fourth frame gradations of type 4 that satisfy the relation of the second frame gradation=third frame gradation>inputted gradation>first frame gradation=fourth frame gradation are generated.

Specifically, the frame gradation generation circuit generates: the first to fourth frame gradations of type 1 if the inputted gradation corresponds to the type 1 pixels; the first to fourth frame gradations of type 2 if the inputted gradation corresponds to the type 2 pixels; the first to fourth frame gradations of type 3 if the inputted gradation corresponds to the type 3 pixels; and the first to fourth gradations of type 4 if the inputted gradation corresponds to type 4 pixels.

Regarding the display units shown in FIG. 2, for example, pixels belonging to display unit A (red, green, and blue) are type 1, pixels belonging to display unit B (red, green, and blue) are type 3, pixels belonging to display unit C (red, green, and blue) are type 2, pixels belonging to display unit D (red, green, and blue) are type 4, pixels belonging to display unit a (red, green, and blue) are type 2, pixels belonging to display unit b (red, green, and blue) are type 4, pixels belonging to display unit c (red, green, and blue) are type 1, and pixels belonging to display unit d (red, green, and blue) are type 3.

The panel driver circuit drives the data signal lines and scan signal lines based on the horizontal synchronization signal, vertical synchronization signal, and the polarity reversal signal generated by the timing signal generation circuit, and applies effective electrical potentials corresponding to the first to fourth frame gradations generated by the frame gradation generation circuit on respective pixels. In this application, a potential obtained by subtracting the lead-in voltage when the transistor is OFF from the signal potential supplied to the pixels from the data signal line is defined as an effective potential (with polarity), and the potential difference between the effective potential and the reference potential (Vcom) (i.e., a voltage actually applied on the pixels) is defined as effective voltage (this is a value representing the magnitude only, without polarity, i.e., absolute value). The drive frequency (frame frequency=rewriting frequency) is preferably 120 Hz, which is the double speed, to 240 Hz, which is the quadruple speed, but not limited to such.

Figure 3:
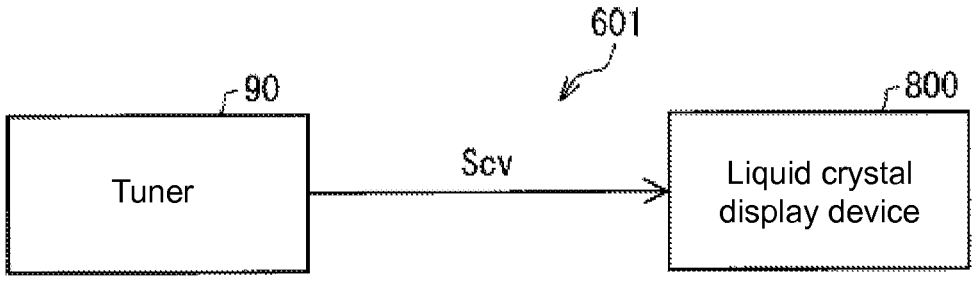
FIG. 3 is a block diagram showing a configuration of the present television receiver.

When the present liquid crystal display device is used to display images of television broadcasting, as shown in FIG. 3, a tuner 90 is connected to the present liquid crystal display device to constitute a television receiver 601. The tuner 90 retrieves an image signal Scv (composite color image signal) from the radiowave received by an antenna (not shown), and inputs the image signal Scv to the present liquid crystal display device.

FIG. 4 and FIG. 5 show an example of LUT 1 and LUT 2 where the image signal is 8-bit, representing 256 gradations. For example, if four frames constitute a cycle for the frame display (each frame is displayed in four frames), when gradation 100 (halftone data) is inputted to type 1 pixels, first frame gradation 195, second frame gradation 195, third frame gradation 0, and fourth frame gradation 0 are generated. When gradation 20 (halftone data) is inputted to type 2 pixels, first frame gradation 0, second frame gradation 0, third frame gradation 91, and fourth frame gradation 91 are generated. When gradation 200 (halftone data) is inputted to type 3 pixels, first frame gradation 255, second frame gradation 38, third frame gradation 38, and fourth frame gradation 255 are generated. When gradation 250 (halftone data) is inputted to type 4 pixels, first frame gradation 244, second frame gradation 255, third frame gradation 255, and fourth frame gradation 244 are generated.

Embodiment 1

Figure 6:
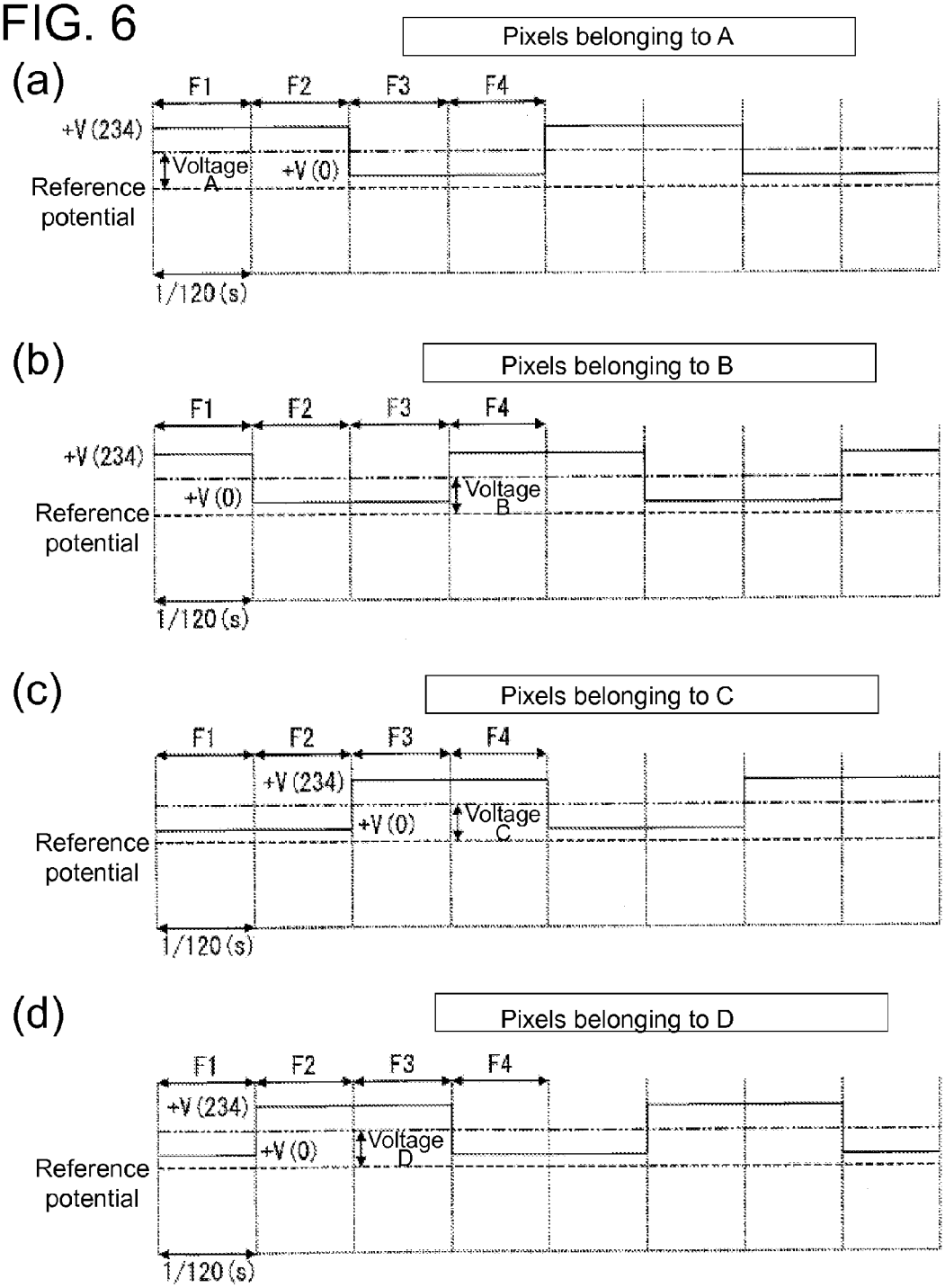
FIG. 6 schematically shows an example of the sequence of the effective electrical potentials applied on pixels belonging to respective display units A to D.
Figure 7:
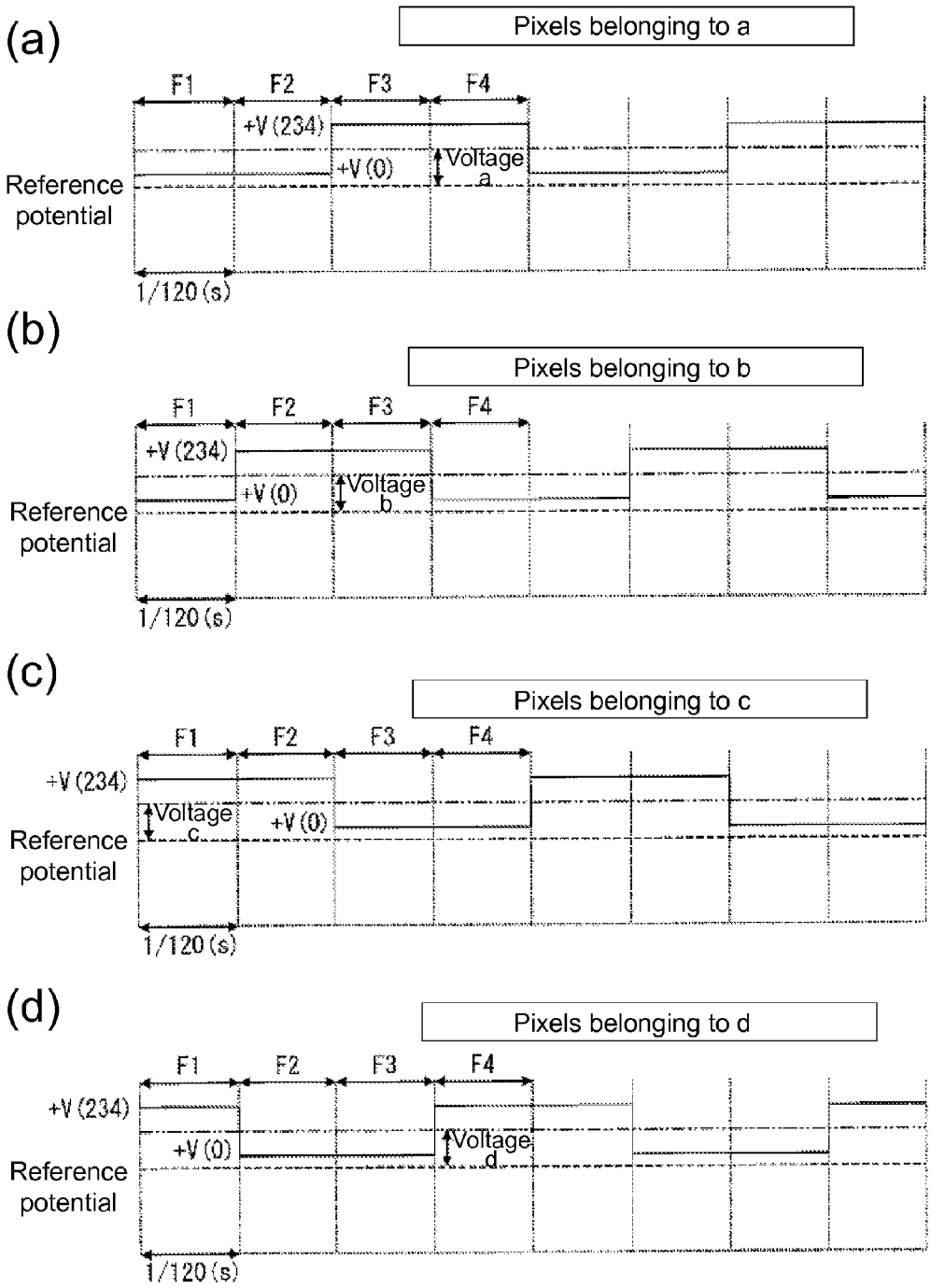
FIG. 7 schematically shows an example of the sequence of the effective electrical potentials applied on pixels belonging to respective display units a to d.

FIG. 6(*a*) to FIG. 6(*d*) are timing charts showing sequences of effective potentials applied on each of the pixels belonging to display units A to D of FIG. 2 when gradation 150 (halftone) is displayed at these display units. FIG. 7(*a*) to FIG. 7(*d*) are timing charts showing sequences of effective potentials applied on pixels belonging to display units a to d of FIG. 2 when gradation 150 (halftone) is displayed at these display units. Here, four frames constitute a cycle, and the drive frequency (frame frequency) is 120 Hz. Voltages A to D of FIG. 6 and voltages a to d of FIG. 7 are the potential differences between the effective potential corresponding to gradation 150 and the reference potential, and the reference potential is the midpoint of the effective potential amplitude (Vcom, for example).

In this case, on pixels belonging to display unit A (type 1), as shown in FIG. 6(*a*), a positive effective potential +V(234) corresponding to gradation 234 is applied during the first frame F1; a positive effective potential +V(234) corresponding to gradation 234 is applied during the second frame F2; a positive effective potential +V(0) corresponding to gradation 0 is applied during the third frame F3; and a positive effective potential +V(0) corresponding to gradation 0 is applied during the fourth frame F4. Here, a relation of the potential difference between +V (0) and the reference potential (effective voltage)<voltage A<the potential difference between +V (234) and the reference potential (effective voltage) is satisfied.

Also, on pixels belonging to display unit B (type 3), as shown in FIG. 6(*b*), a positive +V(234) corresponding to gradation 234 is applied during the first frame F1; a positive effective potential +V(0) corresponding to gradation 0 is applied during the second frame F2; a positive effective potential +V(0) corresponding to gradation 0 is applied during the third frame F3; and a positive effective potential +V(234) corresponding to gradation 234 is applied during the fourth frame F4. Here, a relation of the potential difference between +V(0) and the reference potential (effective voltage) <voltage B<the potential difference between +V(234) and the reference potential (effective voltage) is satisfied.

Also, on pixels belonging to display unit C (type 2), as shown in FIG. 6(*c*), a positive effective potential +V(0) corresponding to gradation 0 is applied during the first frame F1; a positive effective potential +V(0) corresponding to gradation 0 is applied during the second frame F2; a positive effective potential +V(234) corresponding to gradation 234 is applied during the third frame F3; and a positive effective potential +V(234) corresponding to gradation 234 is applied during the fourth frame F4. Here, a relation of the potential difference between +V(0) and the reference potential (effective voltage)<voltage C<the potential difference between +V(234) and the reference potential (effective voltage) is satisfied.

Also, on pixels belonging to display unit D (type 4), as shown in FIG. 6(*d*), a positive effective potential +V(0) corresponding to gradation 0 is applied during the first frame F1; a positive effective potential +V(234) corresponding to gradation 234 is applied during the second frame F2; a positive effective potential +V(234) corresponding to gradation 234 is applied during the third frame F3; and a positive effective potential +V(0) corresponding to gradation 0 is applied during the fourth frame F4. Here, a relation of the potential difference between +V(0) and the reference potential (effective voltage)<voltage D<the potential difference between +V(234) and the reference potential (effective voltage) is satisfied.

Further, on pixels belonging to display unit a (type 2), as shown in FIG. 7(*a*), a positive effective potential +V(0) corresponding to gradation 0 is applied during the first frame F1; a positive effective potential +V(0) corresponding to gradation 0 is applied during the second frame F2; a positive effective potential +V(234) corresponding to gradation 234 is applied during the third frame F3; and a positive effective potential +V(234) corresponding to gradation 234 is applied during the fourth frame F4. Here, a relation of the potential difference between +V(0) and the reference potential (effective voltage)<voltage a<the potential difference between +V(234) and the reference potential (effective voltage) is satisfied.

Also, on pixels belonging to display unit b (type 4), as shown in FIG. 7(*b*), a positive effective potential +V(0) corresponding to gradation 0 is applied during the first frame F1; a positive effective potential +V(234) corresponding to gradation 234 is applied during the second frame F2; a positive effective potential +V(234) corresponding to gradation 234 is applied during the third frame F3; and a positive effective potential +V(0) corresponding to gradation 0 is applied during the fourth frame F4. Here, a relation of the potential difference between +V(0) and the reference potential (effective voltage)<voltage b<the potential difference between +V(234) and the reference potential (effective voltage) is satisfied.

Also, on pixels belonging to display unit c (type 1), as shown in FIG. 7(*c*), a positive effective potential +V(234) corresponding to gradation 234 is applied during the first frame F1; a positive effective potential +V(234) corresponding to gradation 234 is applied during the second frame F2; a positive effective potential +V(0) corresponding to gradation 0 is applied during the third frame F3; and a positive effective potential +V(0) corresponding to gradation 0 is applied during the fourth frame F4. Here, a relation of the potential difference between +V(0) and the reference potential (effective voltage)<voltage c<the potential difference between +V(234) and the reference potential (effective voltage) is satisfied.

Also, on pixels belonging to display unit d (type 3), as shown in FIG. 7(*d*), a positive effective potential +V(234) corresponding to gradation 234 is applied during the first frame F1; a positive effective potential +V(0) corresponding to gradation 0 is applied during the second frame F2; a positive effective potential +V(0) corresponding to gradation 0 is applied during the third frame F3; and a positive effective potential +V(234) corresponding to gradation 234 is applied during the fourth frame F4. Here, a relation of the potential difference between +V(0) and the reference potential (effective voltage)<voltage d<the potential difference between +V(234) and the reference potential (effective voltage) is satisfied.

Figure 8:
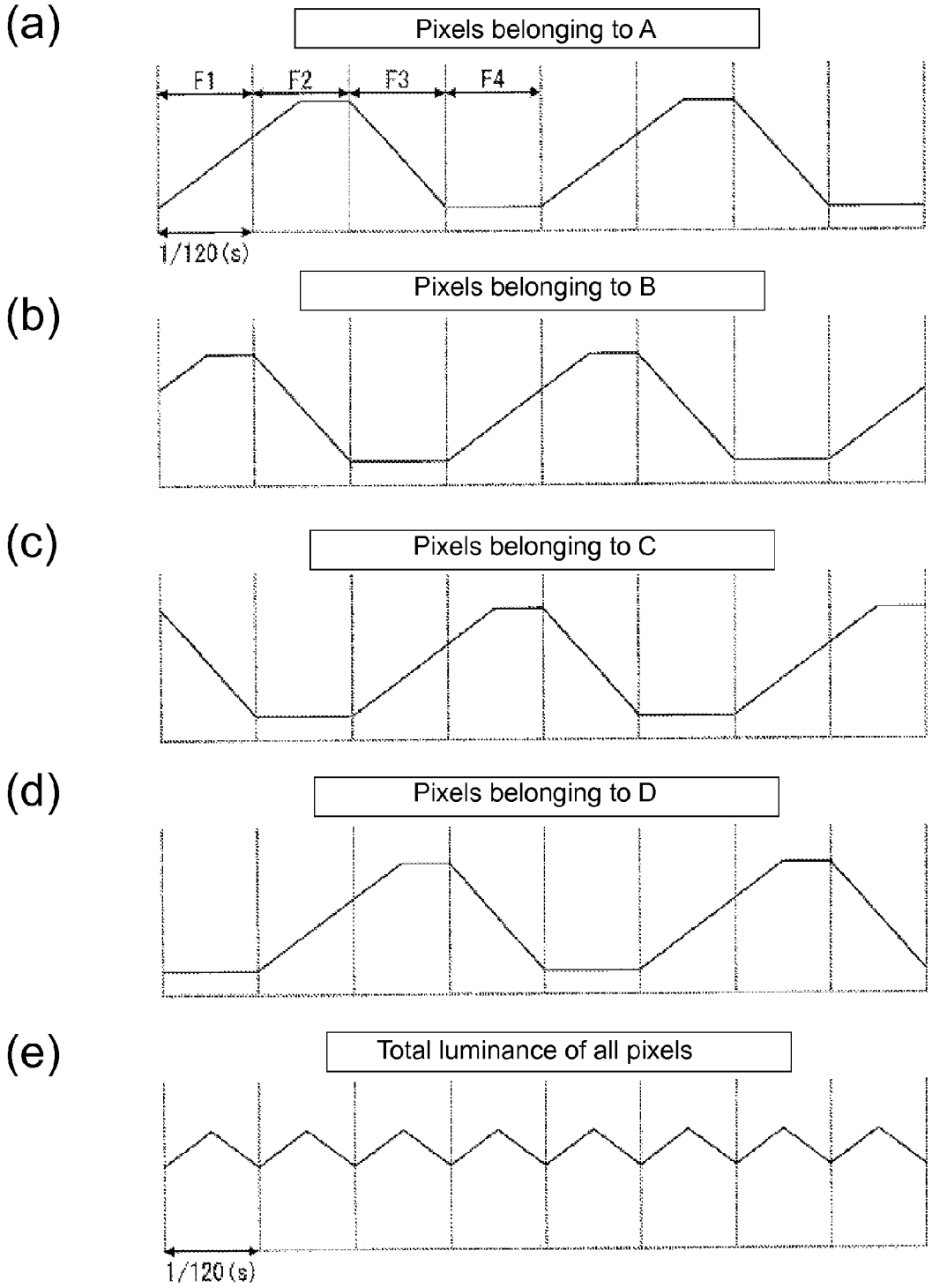
FIG. 8 schematically shows the luminance variation patterns and flicker occurrences at pixels belonging to respective display units A to D when driving as shown in FIG. 6 is conducted.
Figure 10:
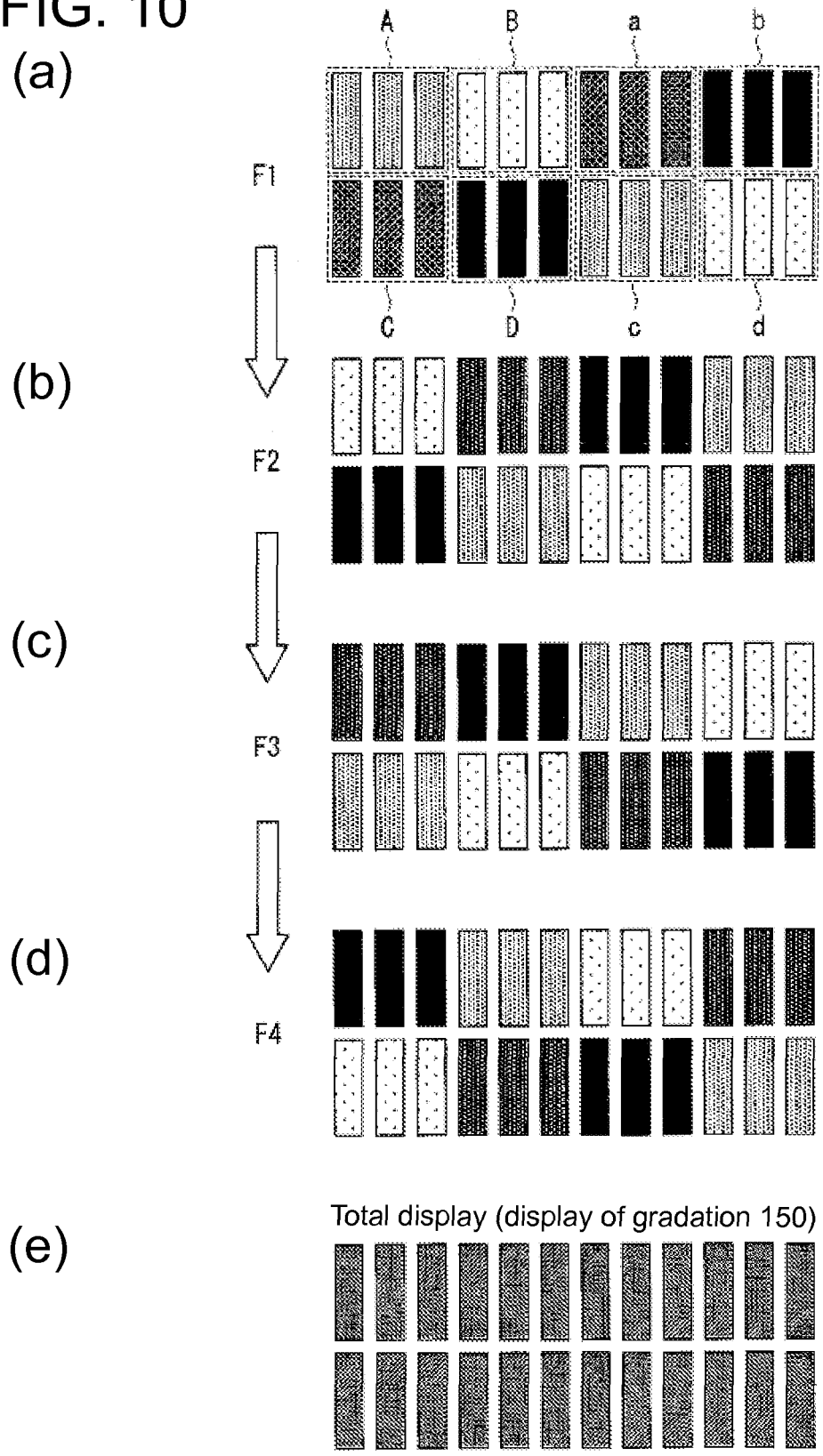
FIG. 10 schematically shows an example of displays at display units A to D and a to d during each of the frames (F1 to F4) and the total of these displays when driving as shown in FIG. 6

As a result of the driving as shown in FIG. 6(*a*) to FIG. 6(*d*), the luminance (transmission) of pixels belonging to display unit A (type 1) changes following the pattern shown in FIG. 8(*a*) during the first frame F1 to the fourth frame F4; the luminance (transmission) of pixels belonging to display unit B (type 3) changes following the pattern shown in FIG. 8(*b*) during the first frame F1 to the fourth frame F4; the luminance (transmission) of pixels belonging to display unit C (type 2) changes following the pattern shown in FIG. 8(*c*) during the first frame F1 to the fourth frame F4; and the luminance (transmission) of pixels belonging to display unit D (type 4) changes following the pattern shown in FIG. 8(*d*) during the first frame F1 to the fourth frame F4. FIG. 10(*a*) to FIG. 10(*d*) schematically show the average luminance of pixels belonging to respective display units A to D during each of the frames (first frame F1-fourth frame F4), and FIG. 10(*e*) schematically shows the total display of the pixels belonging to the respective display units A to D during the first frame F1 to the fourth frame F4.

Figure 9:
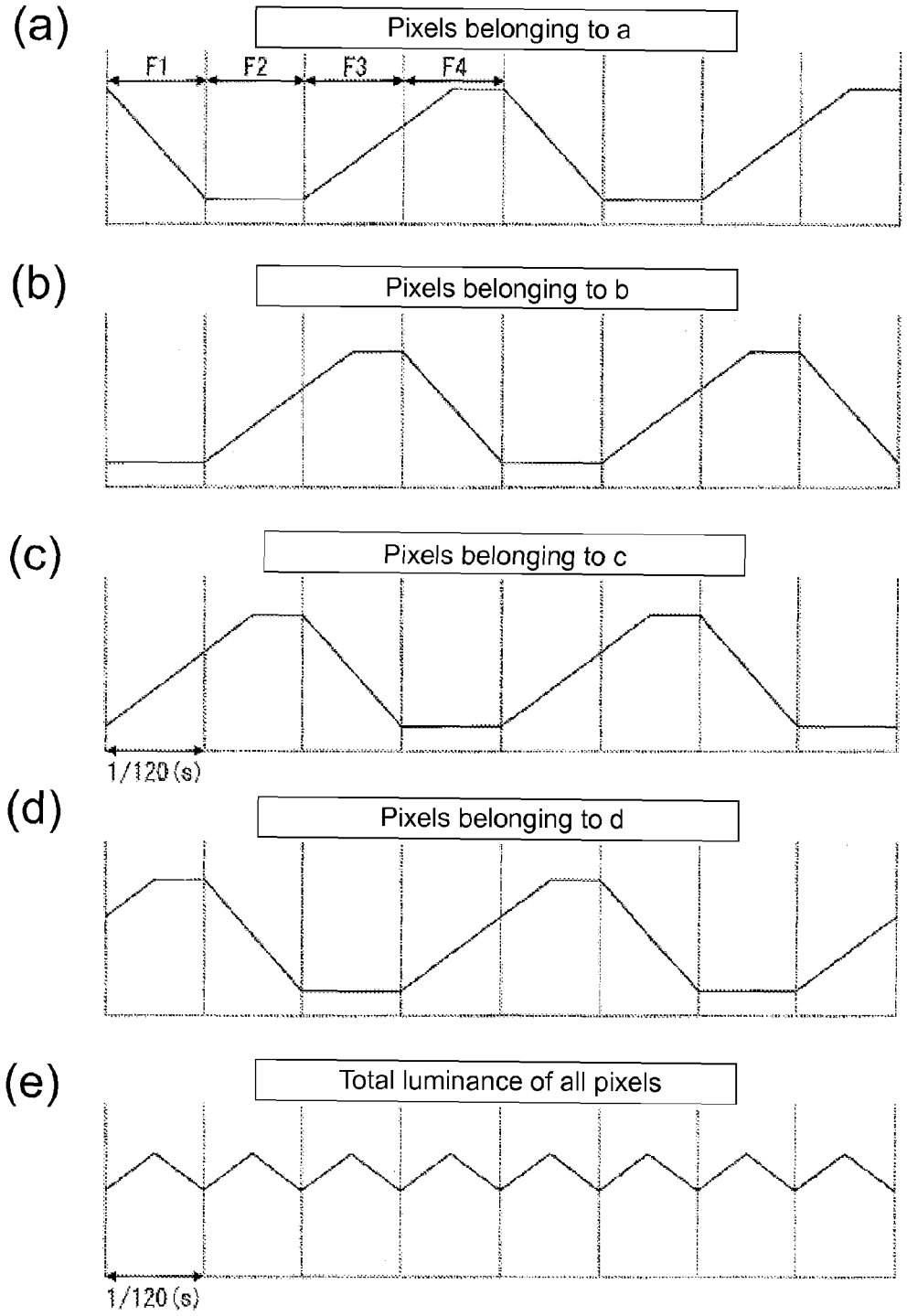
FIG. 9 schematically shows the luminance variation patterns and the flicker occurrences at pixels belonging to display units a to d when driving as shown in FIG. 7 is conducted.

As a result of the driving as shown in FIG. 7(*a*) to FIG. 7(*d*), the luminance (transmission) of pixels belonging to display unit a (type 2) changes following the pattern shown in FIG. 9(*a*) during the first frame F1 to the fourth frame F4; the luminance (transmission) of pixels belonging to display unit b (type 4) changes following the pattern shown in FIG. 9(*b*) during the first frame F1 to the fourth frame F4; the luminance (transmission) of pixels belonging to display unit c (type 1) changes following the pattern shown in FIG. 9(*c*) during the first frame F1 to the fourth frame F4; and the luminance (transmission) of pixels belonging to display unit d (type 3) changes following the pattern shown in FIG. 9(*d*) during the first frame F1 to the fourth frame F4. FIG. 10(*a*) to FIG. 10(*d*) schematically show the average luminance of pixels belonging to respective display units a to d during each of the frames (first frame F1-fourth frame F4), and FIG. 10(*e*) schematically shows the total display of the pixels belonging to respective display units a to d during the first frame F1 to the fourth frame F4.

As shown in FIG. 8 to FIG. 10, in Embodiment 1, a cycle is a four-frame period, and a term is a one-frame period. Pixels included in A or c rise during the first term (F1), rise during the second term (F2), decay during the third term (F3), and stay on hold during the fourth term (F4); pixels included in C or a decay during the first term (F1), stay on hold during the second term (F2), rise during the third term (F3), and rise during the fourth term (F4); pixels included in B or d rise during the first term (F1), decay during the second term (F2), stay on hold during the third term (F3), and rise during the fourth term (F4); pixels included in D or b stay on hold during the first term (F1), rise during the second term (F2), rise during the third term (F3), and decay during the fourth term (F4), where "rise" means that the luminance increases during the term, "decay" means that the luminance decreases during the term, and "stay on hold" means that the same luminance is maintained during the term. Here, pixels of different types have luminance peaks at different times in a cycle. That is, within a cycle, the intervals at which luminance peaks of any two different types of pixels appear are whole-number multiples of one (4/4=1) frame period. More specifically, within a cycle, the type 1 pixels have their luminance peaks one-frame period after the type 3 pixels, the type 4 pixels have their luminance peaks one frame period after the type 1 pixels, and the type 2 pixels have their luminance peaks one frame period after the type 4 pixels. Further, type 1, 2, and 4 pixels have two consecutive frame periods at the end of which the luminance becomes higher than the average luminance of the cycle. The luminance values of the type 3 pixels at the end of the first frame period F1 and at the end of the fourth frame period F4 are both higher than the average luminance of the cycle (F1 to F4).

Thus, the present liquid crystal display device displays each gradation by changing the luminance of pixels. As a result, the viewing angle characteristics can be improved. Also, by providing four luminance variation patterns (bright/dark patterns) at individual pixels in a cycle when a halftone is displayed (in particular, when a same halftone is displayed at pixels of the same color), as illustrated in FIG. 8(*e*) in which luminance variations of pixels belonging to display units A to D are superimposed together, and as illustrated in FIG. 9(*e*) in which luminance variations of pixels belonging to display units a to d are superimposed together, the frequency of the display flickering becomes 120 Hz, which is beyond the human recognition range, and also the magnitude of the flickering (flicker amplitude) is reduced. Further, the present liquid crystal display device has two consecutive frame periods, at the end of each of which the luminance is higher than the average luminance of the cycle (bright frame periods). As a result, the amount of the change in the pixel luminance can be increased and therefore favorable viewing angle characteristics can be realized.

In the present liquid crystal display device, the total number of the type 1 display units, the total number of the type 2 display units, the total number of the type 3 display units, and the total number of the type 4 display units are about the same. That is, the number of the largest group of display units of one type is preferably up to 1.1 times more than the number of the smallest group of display units of another type. However, the number of the largest group of display units of one type may be up to 3 times more than the smallest group of display units of another type.

Figure 11:
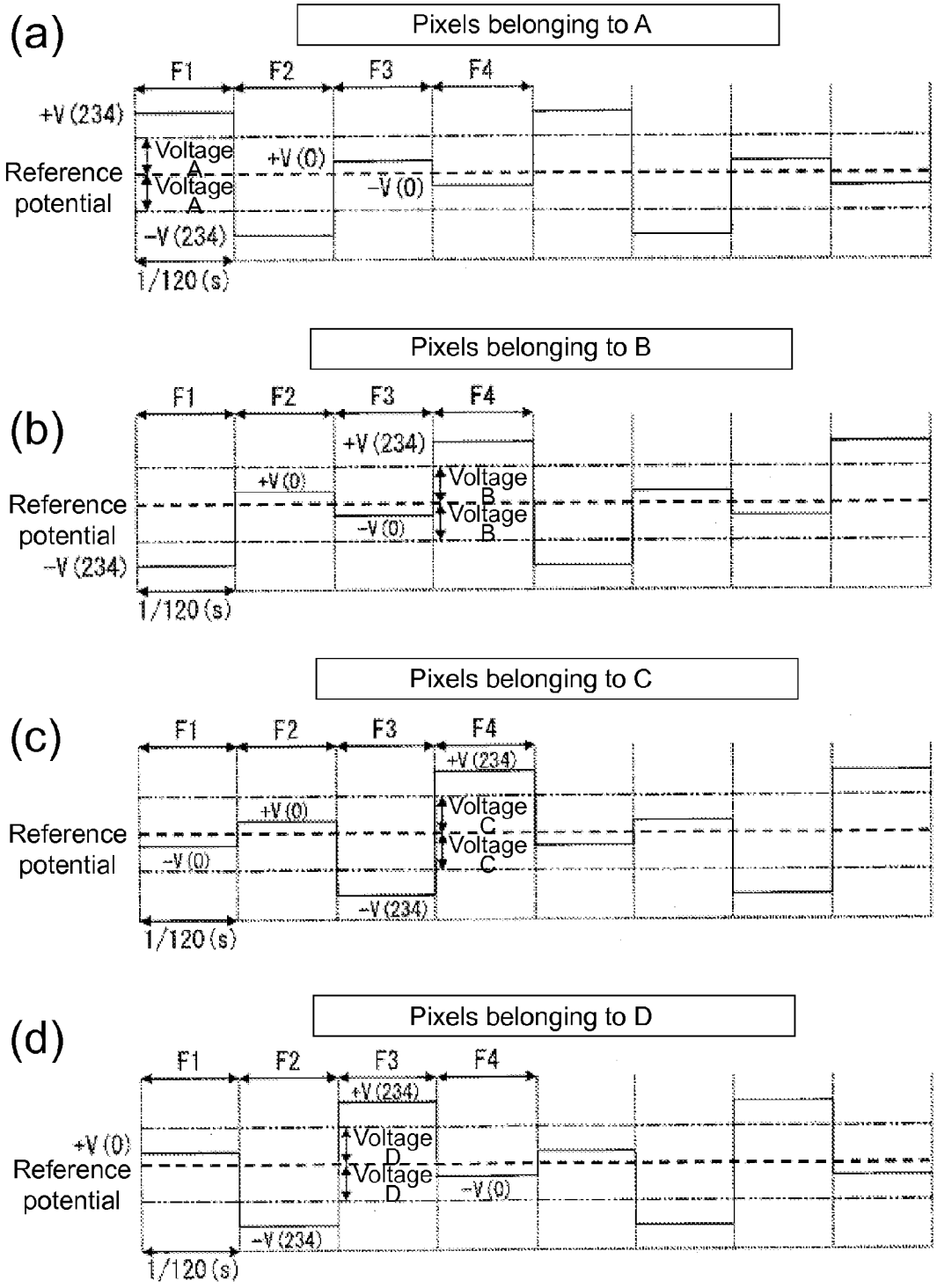
FIG. 11 schematically shows another example of the effective potential sequences that realize the luminance variation patterns as shown in FIG. 8.
Figure 12:
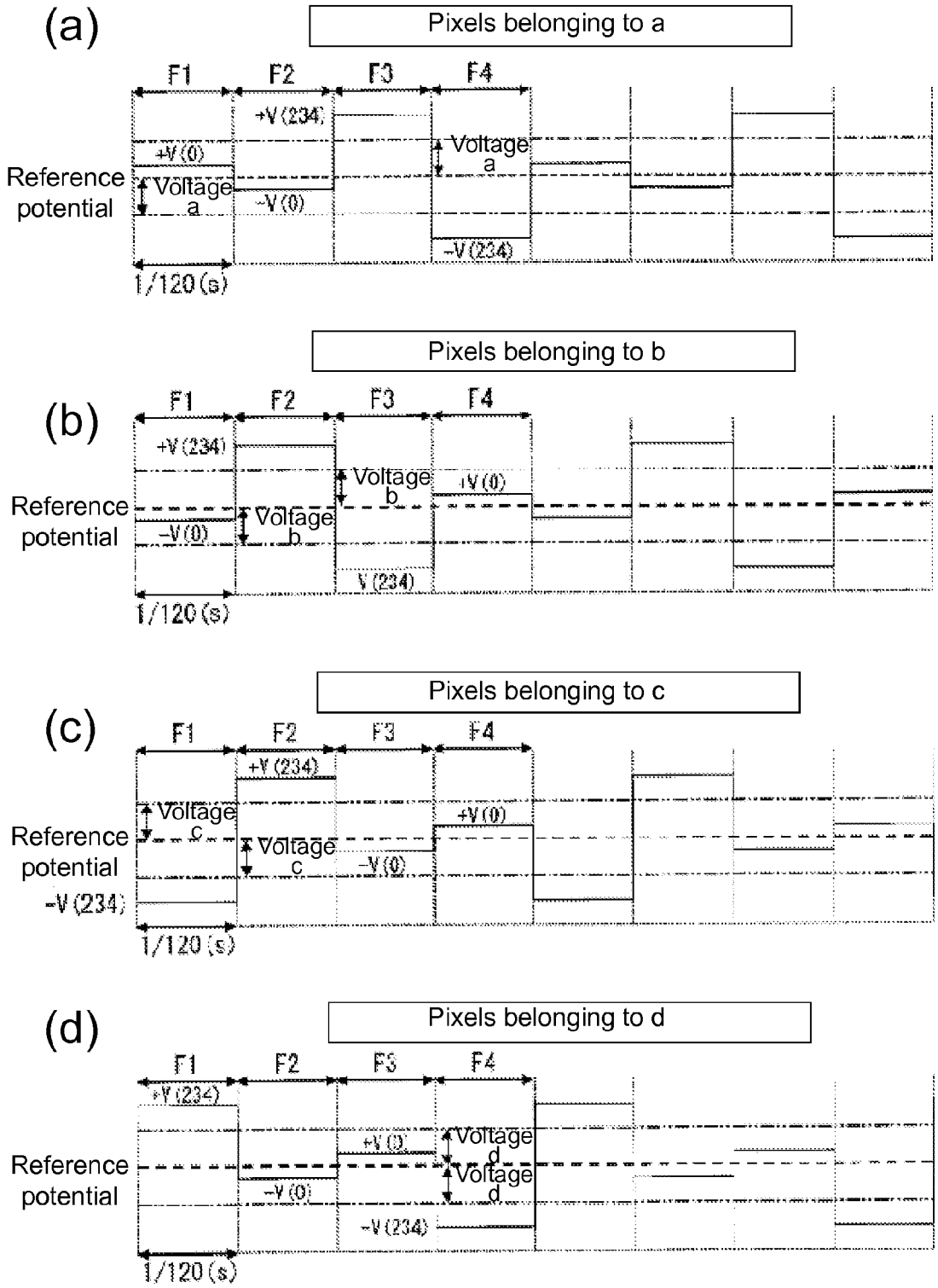
FIG. 12 schematically shows another example of the effective potential sequences that realize the luminance variation patterns as shown in FIG. 9.

FIG. 6 and FIG. 7 show the case where effective potentials of the same polarity are applied on pixels during a cycle, and the effective potentials applied on two adjacent pixels are of the same polarity. However, the present invention is not limited to this. For example, as shown in FIG. 11 and FIG. 12, the polarity of the effective potential applied on pixels during a cycle (F1-F4) may be reversed for every frame, and the effective potentials of two adjacent pixels may have opposite polarities. Here, voltage A to voltage D of FIG. 11 and voltage a to voltage d of FIG. 12 each represents the potential difference between the effective potential corresponding to gradation 150 and the reference potential, and the reference potential represents the midpoint of the effective potential amplitude (Vcom, for example).

In this case, on pixels belonging to display unit A (type 1), as shown in FIG. 11(*a*), a positive effective potential +V(234) corresponding to gradation 234 is applied during the first frame F1; a negative effective potential −V(234) corresponding to gradation 234 is applied during the second frame F2; a positive effective potential +V(0) corresponding to gradation 0 is applied during the third frame F3; and a negative effective potential −V(0) corresponding to gradation 0 is applied during the fourth frame F4.

Here, a relation of the potential difference between +V(0) and the reference potential (effective voltage)=the potential difference between −V(0) and the reference potential (effective voltage)<voltage A<the potential difference between +V(234) and the reference potential (effective voltage)=the potential difference between −V(234) and the reference potential (effective voltage) is satisfied.

Also, on pixels belonging to display unit B (type 3), as shown in FIG. 11(*b*), a negative effective potential −V(234) corresponding to gradation 234 is applied during the first frame F1; a positive effective potential +V(0) corresponding to gradation 0 is applied during the second frame F2; a negative effective potential −V(0) corresponding to gradation 0 is applied during the third frame F3; and a positive effective potential +V(234) corresponding to gradation 234 is applied during the fourth frame F4.

Here, a relation of the potential difference between +V(0) and the reference potential (effective voltage)=the potential difference between −V(0) and the reference potential (effective voltage)<voltage B<the potential difference between +V(234) and the reference potential (effective voltage)=the potential difference between −V(234) and the reference potential (effective voltage) is satisfied.

Also, on pixels belonging to display unit C (type 2), as shown in FIG. 11(*c*), a negative effective potential −V(0) corresponding gradation 0 is applied during the first frame F1; a positive effective potential +V(0) corresponding gradation 0 is applied during the second frame F2; a negative effective potential −V(234) corresponding to gradation 234 is applied during the third frame F3; and a positive effective potential +V(234) corresponding to gradation 234 is applied during the fourth frame F4.

Here, a relation of the potential difference between +V(0) and the reference potential (effective voltage)=the potential difference between −V(0) and the reference potential (effective voltage)<voltage C<the potential difference between +V(234) and the reference potential (effective voltage)=the potential difference between −V(234) and the reference potential (effective voltage) is satisfied. Also, on pixels belonging to display unit D (type 4), as shown in FIG. 11(*d*), a positive effective potential +V(0) corresponding to gradation 0 is applied during the first frame F1; a negative effective potential −V(234) corresponding to gradation 234 is applied during the second frame F2; a positive effective potential +V(234) corresponding to gradation 234 is applied during the third frame F3; and a negative effective potential −V(0) corresponding to gradation 0 is applied during the fourth frame F4.

Here, a relation of the potential difference between +V(0) and the reference potential (effective voltage)=the potential difference between −V(0) and the reference potential (effective voltage)<voltage D<the potential difference between +V(234) and the reference potential (effective voltage)=the potential difference between −V(234) and the reference potential (effective voltage) is satisfied.

Further, on pixels belonging to display unit a (type 2), as shown in FIG. 12(*a*), a positive effective potential +V(0) corresponding to gradation 0 is applied during the first frame F1; a negative effective potential −V(0) corresponding to gradation 0 is applied during the second frame F2; a positive effective potential +V(234) corresponding to gradation 234 is applied during the third frame F3; and a negative effective potential −V(234) corresponding to gradation 234 is applied during the fourth frame F4.

Here, a relation of the potential difference between +V(0) and the reference potential (effective voltage)=the potential difference between −V(0) and the reference potential (effective voltage)<voltage a<the potential difference between +V(234) and the reference potential (effective voltage)=the potential difference between −V(234) and the reference potential (effective voltage) is satisfied.

Also, on pixels belonging to display unit b (type 4), as shown in FIG. 12(*b*), a negative effective potential −V(0) corresponding to gradation 0 is applied during the first frame F1; a positive effective potential +V(234) corresponding to gradation 234 is applied during the second frame F2; a negative effective potential −V(234) corresponding to gradation 234 is applied during the third frame F3; and a positive effective potential +V(0) corresponding to gradation 0 is applied during the fourth frame F4.

Here, a relation of the potential difference between +V(0) and the reference potential (effective voltage)=the potential difference between −V(0) and the reference potential (effective voltage)<voltage b<the potential difference between +V(234) and the reference potential (effective voltage)=the potential difference between −V(234) and the reference potential (effective voltage) is satisfied.

Also, on pixels belonging to display unit c (type 1), as shown in FIG. 12(*c*), a negative effective potential −V(234) corresponding to gradation 234 is applied during the first frame F1; a positive effective potential +V(234) corresponding to gradation 234 is applied during the second frame F2; a negative effective potential −V(0) corresponding to gradation 0 is applied during the third frame F3; and a positive effective potential +V(0) corresponding to gradation 0 is applied during the fourth frame F4.

Here, a relation of the potential difference between +V(0) and the reference potential (effective voltage)=the potential difference between −V(0) and the reference potential (effective voltage)<voltage c<the potential difference between +V(234) and the reference potential (effective voltage)=the potential difference between −V(234) and the reference potential (effective voltage) is satisfied.

Also, on pixels belonging to display unit d (type 3), as shown in FIG. 12(*d*), a positive effective potential +V(234) corresponding to gradation 234 is applied during the first frame F1; a negative effective potential −V(0) corresponding to gradation 0 is applied during the second frame F2; a positive effective potential +V(0) corresponding to gradation 0 is applied during the third frame F3, and a negative effective potential −V(234) corresponding to gradation 234 is applied during the fourth frame F4.

Here, a relation of the potential difference between +V(0) and the reference potential (effective voltage)=the potential difference between −V(0) and the reference potential (effective voltage)<voltage d<the potential difference between +V(234) and the reference potential (effective voltage)=the potential difference between −V(234) and the reference potential (effective voltage) is satisfied.

Here, as a result of the driving shown in FIG. 11(*a*) to FIG. 11(*d*), the luminance (transmission) of pixels belonging to display unit A (type 1) changes following the pattern shown in FIG. 8(*a*) during the first frame F1 to the fourth frame F4; the luminance (transmission) of pixels belonging to display unit B (type 3) changes following the pattern shown in FIG. 8(*b*) during the first frame F1 to the fourth frame F4; the luminance (transmission) of pixels belonging to display unit C (type 2) changes following the pattern shown in FIG. 8(*c*) during the first frame F1 to the fourth frame F4; and the luminance (transmission) of pixels belonging to display unit D (type 4) changes following the pattern shown in FIG. 8(*d*) during the first frame F1 to the fourth frame F4.

Also, as a result of the driving shown in FIG. 12(*a*) to FIG. 12(*d*), the luminance (transmission) of pixels belonging to display unit a (type 2) changes following the pattern shown in FIG. 9(*a*) during the first frame F1 to the fourth frame F4; the luminance (transmission) of pixels belonging to display unit b (type 4) changes following the pattern shown in FIG. 9(*b*) during the first frame F1 to the fourth frame F4; the luminance (transmission) of pixels belonging to display unit c (type 1) changes following the pattern shown in FIG. 9(*c*) during the first frame F1 to the fourth frame F4; and the luminance (transmission) of pixels belonging to display unit d (type 3) changes following the pattern shown in FIG. 9(*d*) during the first frame F1 to the fourth frame F4.

Embodiment 2

In FIG. 6 to FIG. 12, four frames constitute a cycle, and the drive frequency (frame frequency) is 120 Hz. However, the present invention is not limited to this. Alternatively, a cycle may be constituted of eight frames, and the drive frequency (frame frequency) may be 240 Hz.

Figure 13:
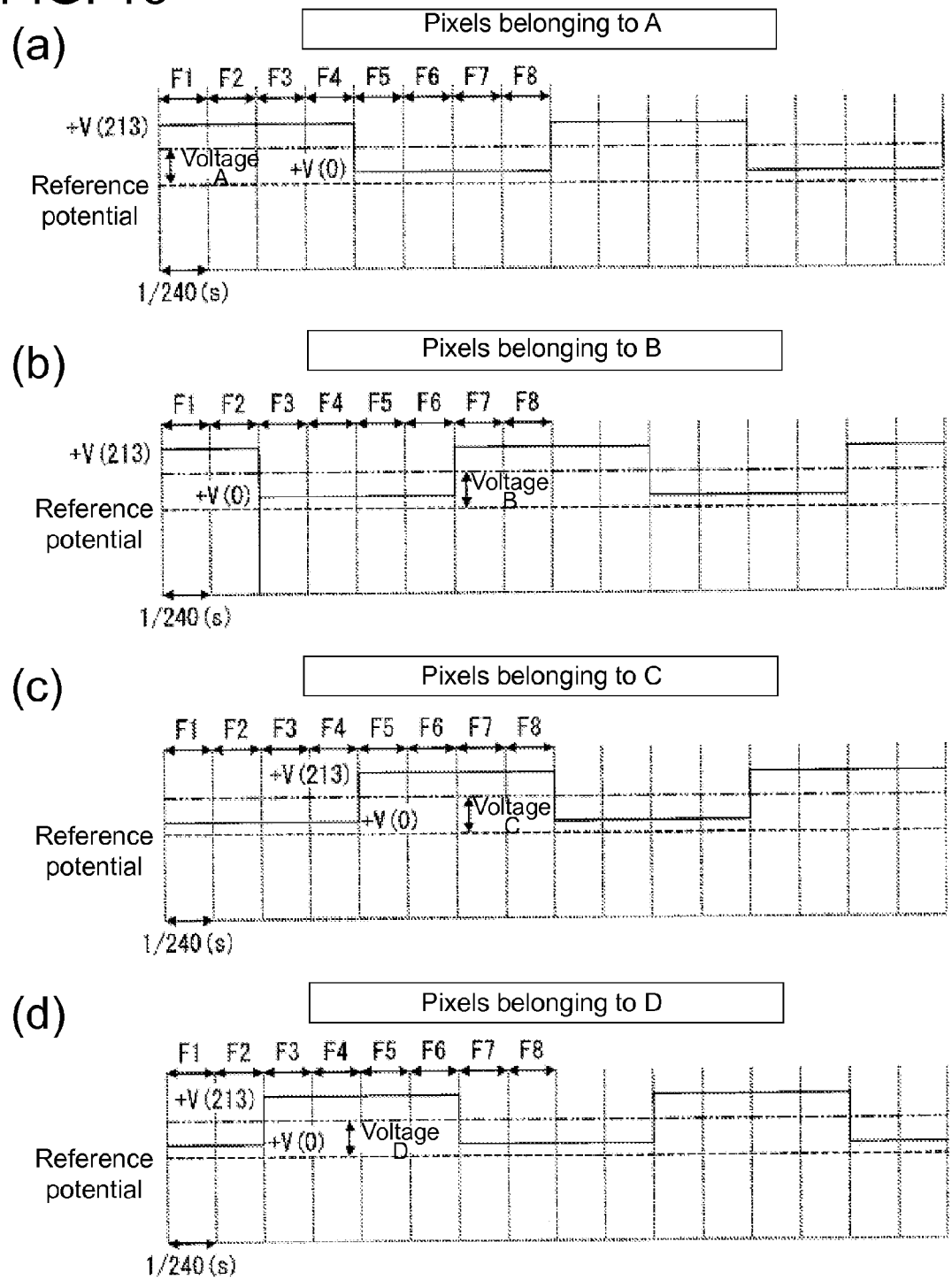
FIG. 13 schematically shows another example of sequences of the effective potentials applied on pixels belonging to respective display units A to D.
Figure 14:
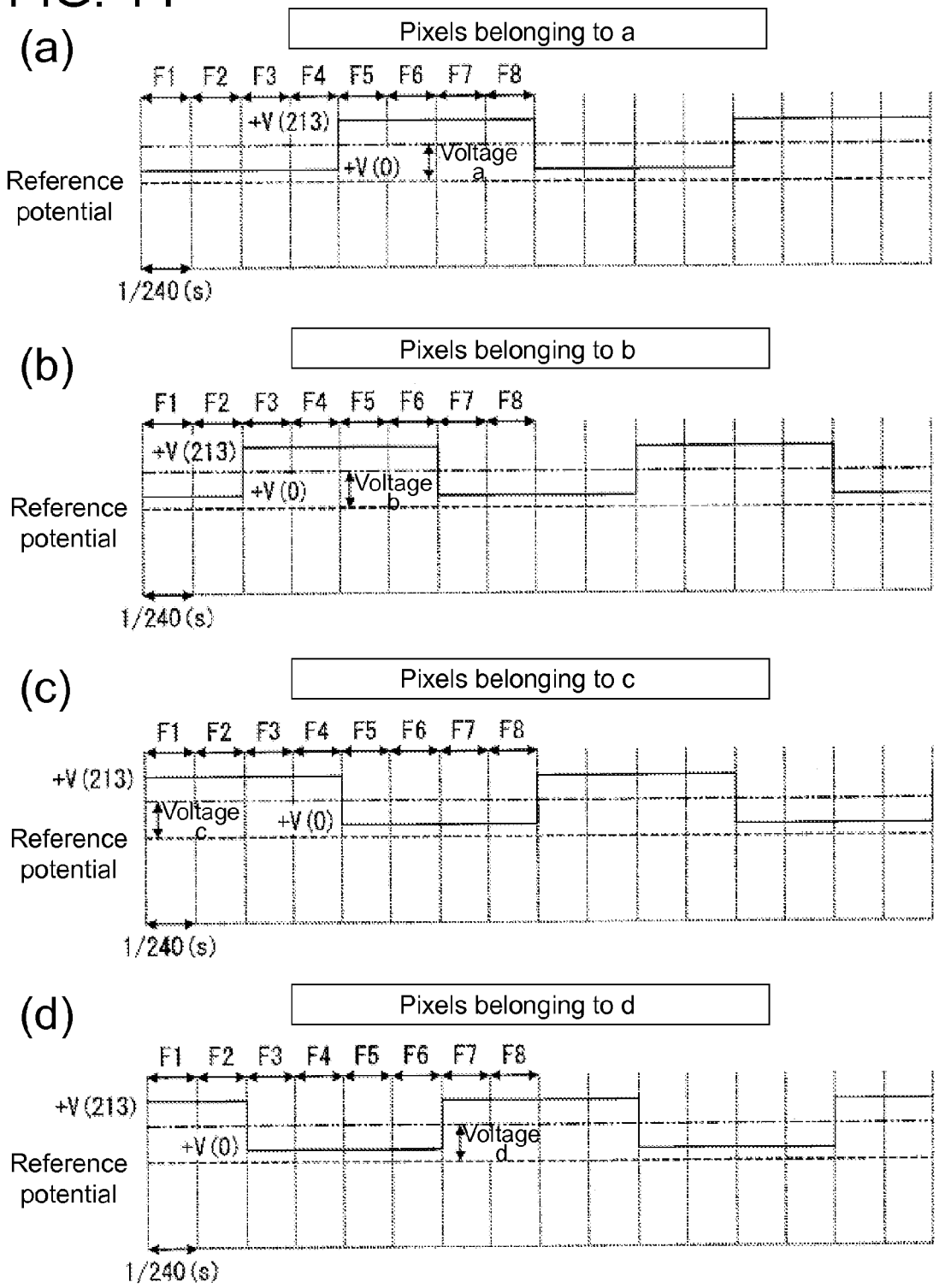
FIG. 14 schematically shows another example of sequences of the effective potentials applied on pixels belonging to respective display units a to d.

FIG. 13(*a*) to FIG. 13(*d*) are timing charts showing sequences of effective potentials applied on pixels belonging to display units A to D of FIG. 2 when gradation 120 (halftone) is displayed at these display units (1 cycle=8 frames, drive frequency=240 Hz). FIG. 14(*a*) to FIG. 14(*d*) are timing charts showing sequences of effective potentials applied on pixels belonging to display units a to d of FIG. 2 when gradation 120 (halftone) is displayed at these display units (1 cycle=8 frames, drive frequency=240 Hz). Here, voltage A to voltage D of FIG. 13 and voltage a to voltage d of FIG. 14 each represents the potential between the effective potential corresponding to gradation 120 and the reference potential, and the reference potential represents the midpoint of the effective potential amplitude (Vcom, for example).

In this case, on pixels belonging to display unit A (type 1), as shown in FIG. 13(*a*), a positive effective potential +V(213) corresponding to gradation 213 is applied during each of the first frame F1 to the fourth frame F4; and a positive effective potential +V(0) corresponding to gradation 0 is applied during each of the fifth frame F5 to the eighth frame F8. Also, a relation of the potential difference between +V(0) and the reference potential (effective voltage)<voltage A<the potential difference between +V(213) and the reference potential (effective voltage) is satisfied.

Also, on pixels belonging to display unit B (type 3), as shown in FIG. 13(*b*), a positive effective potential +V(213) corresponding to gradation 213 is applied during each of the first frame F1 and the second frame F2; a positive effective potential +V(0) corresponding to gradation 0 is applied during each of the third frame F3 to the sixth frame F6; and a positive effective potential +V(213) corresponding to gradation 213 is applied during each of the seventh frame F7 and the eighth frame F8. Here, a relation of the potential difference between +V(0) and the reference potential (effective voltage)<voltage B<the potential difference between +V(213) and the reference potential (effective voltage) is satisfied.

Also, on pixels belonging to display unit C (type 2), as shown in FIG. 13(*c*), a positive effective potential +V(0) corresponding to gradation 0 is applied during each of the first frame F1 to the fourth frame F4; and a positive effective potential +V(213) corresponding to gradation 213 is applied during each of the fifth frame F5 to the eighth frame F8. Here, a relation of the potential difference between +V(0) and the reference potential (effective voltage)<voltage C<the difference between +V(213) and the reference potential (effective voltage) is satisfied.

Also, on pixels belonging to display unit D (type 4), as shown in FIG. 13(*d*), a positive effective potential +V(0) corresponding to gradation 0 is applied during each of the first frame F1 and the second frame F2; a positive effective potential +V(213) corresponding to gradation 213 is applied during each of the third frame F3 to the sixth frame F6; and a positive effective potential +V(0) corresponding to gradation 0 is applied during each of the seventh frame F7 and the eighth frame F8. Here, a relation of the potential difference between +V(0) and the reference potential (effective voltage)<voltage D<the potential difference between +V(213) and the reference potential (effective voltage) is satisfied.

Further, on pixels belonging to display unit a (type 2), as shown in FIG. 14(*a*), a positive effective potential +V(0) corresponding to gradation 0 is applied during each of the first frame F1 to the fourth frame F4; and a positive effective potential +V(213) corresponding to gradation 213 is applied during each of the fifth frame F5 to the eighth frame F8. Also, a relation of the potential difference between +V(0) and the reference potential (effective voltage)<voltage a<the potential difference between +V(213) and the reference potential (effective voltage) is satisfied.

Also, on pixels belonging to display unit b (type 4), as shown in FIG. 14(*b*), a positive effective potential +V(0) corresponding to gradation 0 is applied during each of the first frame F1 and the second frame F2; a positive effective potential +V(213) corresponding to gradation 213 is applied during each of the third frame F3 to the sixth frame F6; and a positive effective potential +V(0) corresponding to gradation 0 is applied during each of the seventh frame F7 and the eighth frame F8. Here, a relation of the potential difference between +V(0) and the reference potential (effective voltage)<voltage b<the potential difference between +V(213) and the reference potential (effective voltage) is satisfied.

Also, on pixels belonging to display unit c (type 1), as shown in FIG. 14(*c*), a positive effective potential +V(213) corresponding to gradation 213 is applied during each of the first frame F1 to the fourth frame F4; a positive effective potential +V(0) corresponding to gradation 0 is applied during each of the fifth frame F5 to the eighth frame F8. Here, a relation of the potential difference between +V(0) and the reference potential (effective voltage)<voltage c<the potential difference between +V(213) and the reference potential (effective voltage) is satisfied.

Also, on pixels belonging to display unit d (type 3), as shown in FIG. 14(*d*), a positive effective potential +V(213) corresponding to gradation 213 is applied during each of the first frame F1 and the second frame F2; a positive effective potential +V(0) corresponding to gradation 0 is applied during each of the third frame F3 to the sixth frame F6; and a positive effective potential +V(213) corresponding to gradation 213 is applied during each of the seventh frame F7 to the eighth frame F8. Here, a relation of the potential difference between +V(0) and the reference potential (effective voltage) <voltage d<the potential difference between +V(213) and the reference potential (effective voltage) is satisfied.

Figure 15:
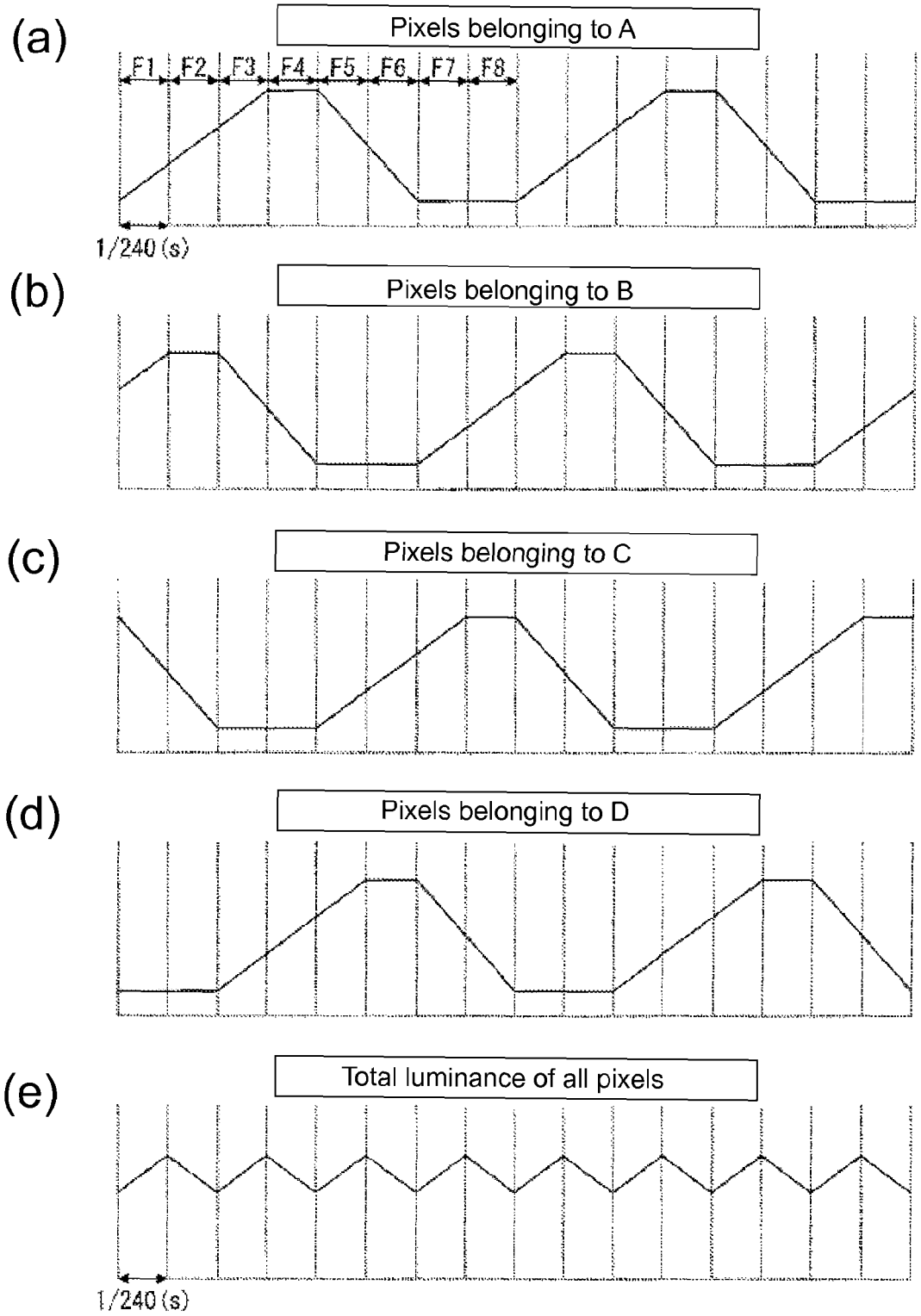
FIG. 15 schematically shows the luminance variation patterns and flickering occurrences at pixels belonging to respective display units A to D when driving as shown in FIG. 13 is conducted.

As a result of the driving shown in FIG. 13(*a*) to FIG. 13(*d*), the luminance (transmission) of pixels belonging to display unit A (type 1) changes following the pattern shown in FIG. 15(*a*) during the first frame F1 to the eighth frame F8; the luminance (transmission) of pixels belonging to display unit B (type 3) changes following the pattern shown in FIG. 15(*b*) during the first frame F1 to the eighth frame F8; the luminance (transmission) of pixels belonging to display unit C (type 2) changes following the pattern shown in FIG. 15(*c*) during the first frame F1 to the eighth frame F8; and the luminance (transmission) of pixels belonging to display unit D (type 4) changes following the pattern shown in FIG. 15(*d*) during the first frame F1 to the eighth frame F8. Here, FIG. 17(*a*) to FIG. 17(*h*) schematically show the average luminance of pixels belonging to respective display units A to D during each of the frames (first frame F1-eighth frame F8), and FIG. 17(*i*) schematically shows the total display of the pixels belonging to the respective display units A to D during the first frame F1 to the eighth frame F8.

Figure 16:
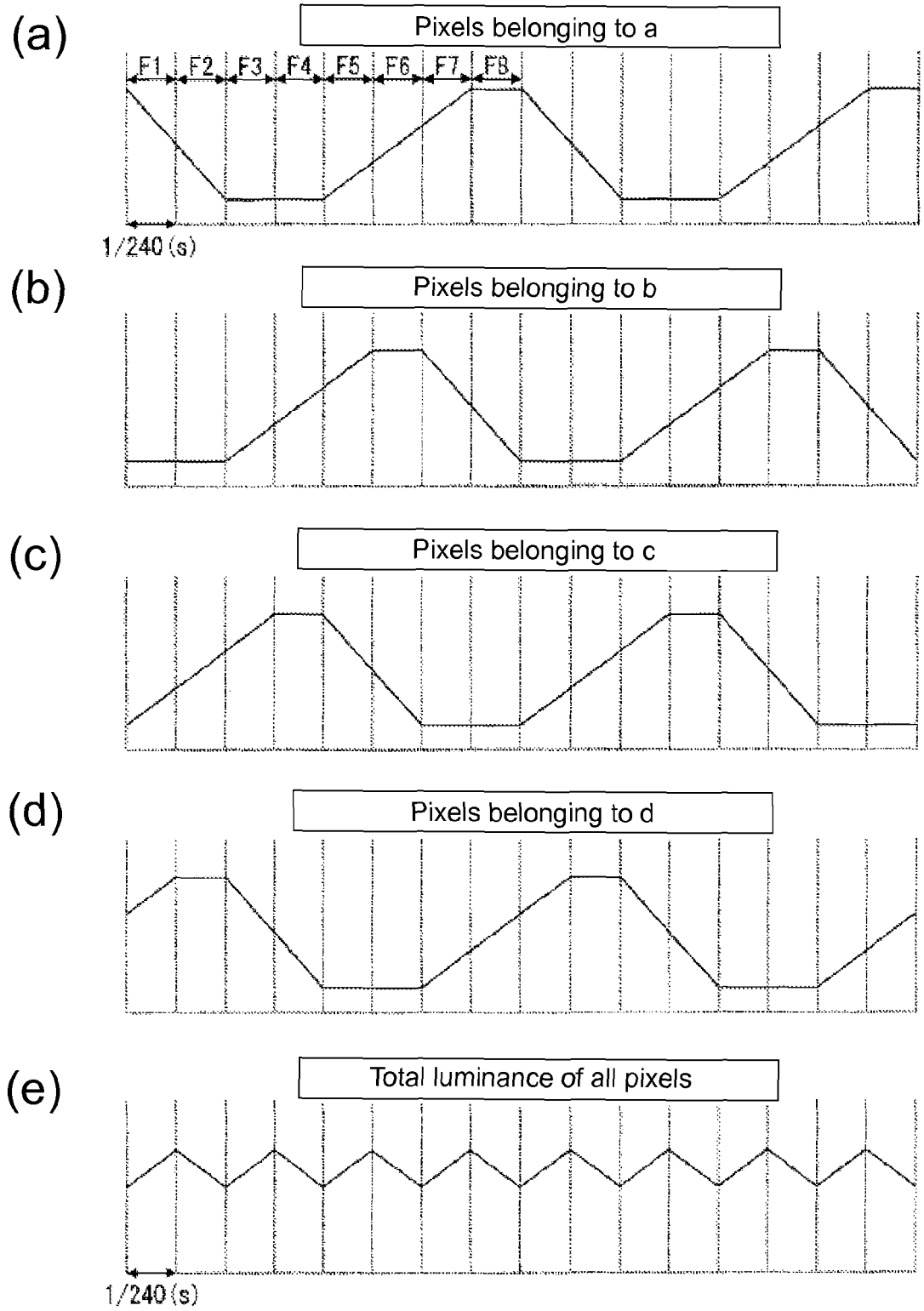
FIG. 16 schematically shows the luminance variation patterns and flickering occurrences at pixels belonging to respective display units a to d when driving as shown in FIG. 14 is conducted.

Also, as a result of the driving shown in FIG. 14(*a*) to FIG. 14(*d*), the luminance (transmission) of pixels belonging to display unit a (type 2) changes following the pattern shown in FIG. 16(*a*) during the first frame F1 to the eighth frame F8; the luminance (transmission) of pixels belonging to display unit b (type 4) changes following the pattern shown in FIG. 16(*b*) during the first frame F1 to the eighth frame F8; the luminance (transmission) of pixels belonging to display unit c (type 1) changes following the pattern shown in FIG. 16(*c*) during the first frame F1 to the eighth frame F8; and the luminance (transmission) of pixels belonging to display unit d (type 3) changes following the pattern shown in FIG. 16(*d*) during the first frame F1 to the eighth frame F8. Here, FIG. 17(*a*) to FIG. 18(*h*) schematically show the average luminance of pixels belonging to respective display units a to d during each of the frames (first frame F1-eighth frame F8), and FIG. 17(*i*) schematically shows the total display of the pixels belonging to the respective display units a to d during the first frame F1 to the eighth frame F8.

Figure 17:
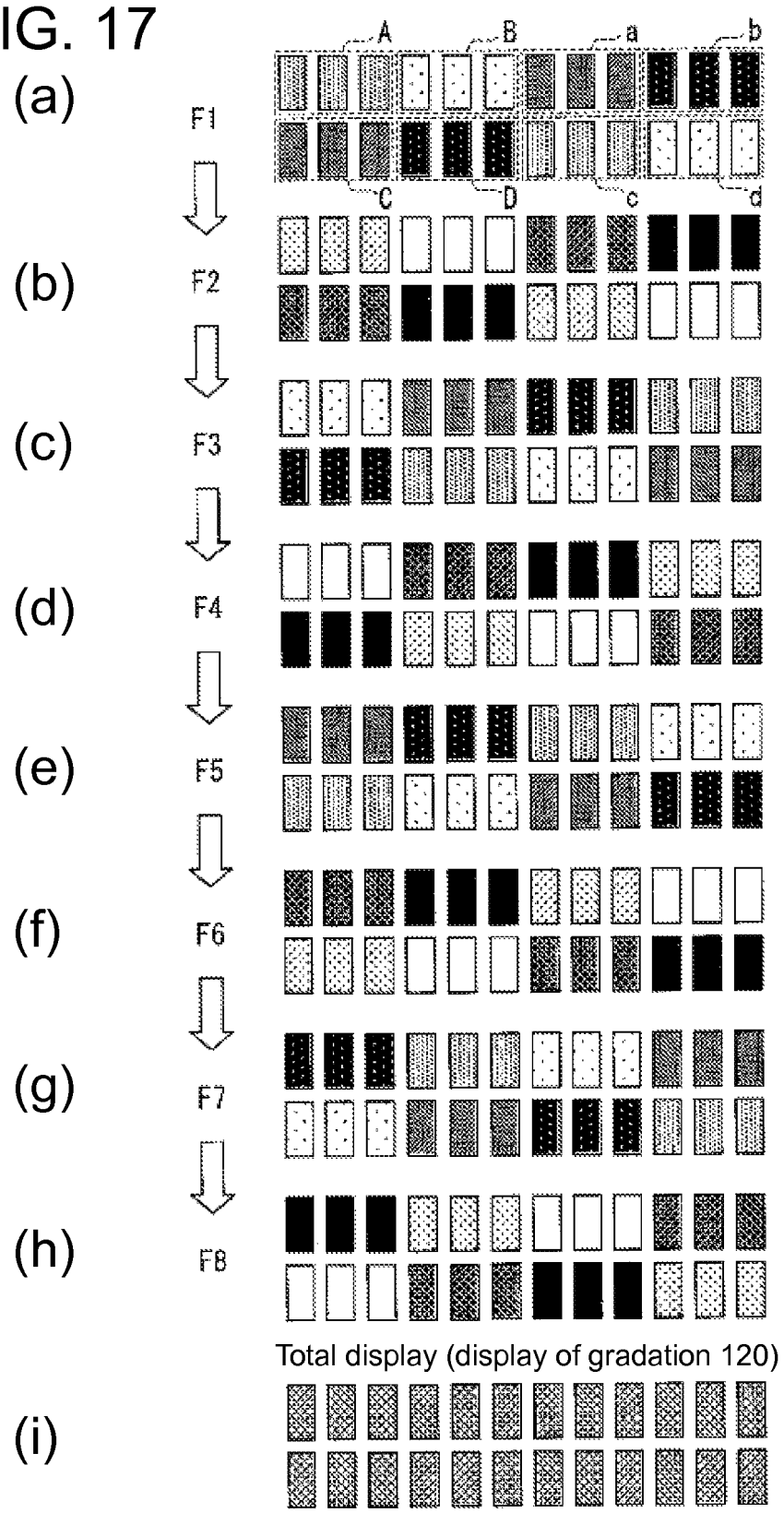
FIG. 17 schematically shows an example of the displays at display units A to D and a to d during each of frames (F1 to F4) and the total of these displays when driving as shown in FIG. 11

As shown in FIG. 15 to FIG. 17, in Embodiment 2, a cycle is an eight-frame period, and a term is a two-frame period. Pixels included in A or c rise during the first term (F1-F2), rise during the second term (F3-F4), decay during the third term (F5-F6), and stay on hold during the fourth term (F7-F8); pixels included in C or a decay during the first term (F1-F2), stay on hold during the second term (F3-F4), rise during the third term (F5-F6), and rise during the fourth term (F7-F8); pixels included in B or d rise during the first term (F1-F2), decay during the second term (F3-F4), stay on hold during the third term (F5-F6), and rise during the fourth term (F7-F8); pixels included in D or b stay on hold during the first term (F1-F2), rise during the second term (F3-F4), rise during the third term (F5-F6), and decay during the fourth term (F7-F8), where "rise" means that the luminance increases during the term, "decay" means that the luminance decreases during the term, and "stay on hold" means that the same luminance is maintained during the term. Here, pixels of different types have luminance peaks at different times in a cycle. That is, within a cycle, the intervals at which luminance peaks of any two different types of pixels appear are whole-number multiples of two (8/4=2) frame period. More specifically, within a cycle, the type 1 pixels have their luminance peaks a two-frame period after the type 3 pixels, the type 4 pixels have their luminance peaks a two-frame period after the type 1 pixels, and the type 2 pixels have their luminance peaks a two-frame period after the type 4 pixels. Further, each of type 1 to 4 pixels has at least two consecutive frame periods at the end of which the luminance becomes higher than the average luminance of the cycle.

Thus, the present liquid crystal display device displays each gradation by changing the luminance of pixels. As a result, the viewing angle characteristics can be improved. Also, by providing four luminance variation patterns (bright/dark patterns) at individual pixels in a cycle when a halftone is displayed (in particular, when a same halftone is displayed at pixels of the same color), as illustrated in FIG. 15(*e*) in which luminance variations of pixels belonging to display units A to D are superimposed together, and as illustrated in FIG. 16(*e*) in which luminance variations of pixels belonging to display units a to d are superimposed together, the frequency of the display flickering becomes 120 Hz, which is beyond the human recognition range, and also the magnitude of the flickering (flicker amplitude) is reduced. Further, the present liquid crystal display device has at least two consecutive frame periods, at the end of each of which the luminance is higher than the average luminance of the cycle (bright frame period). As a result, the amount of the change in the pixel luminance can be increased and therefore favorable viewing angle characteristics can be realized.

Figure 18:
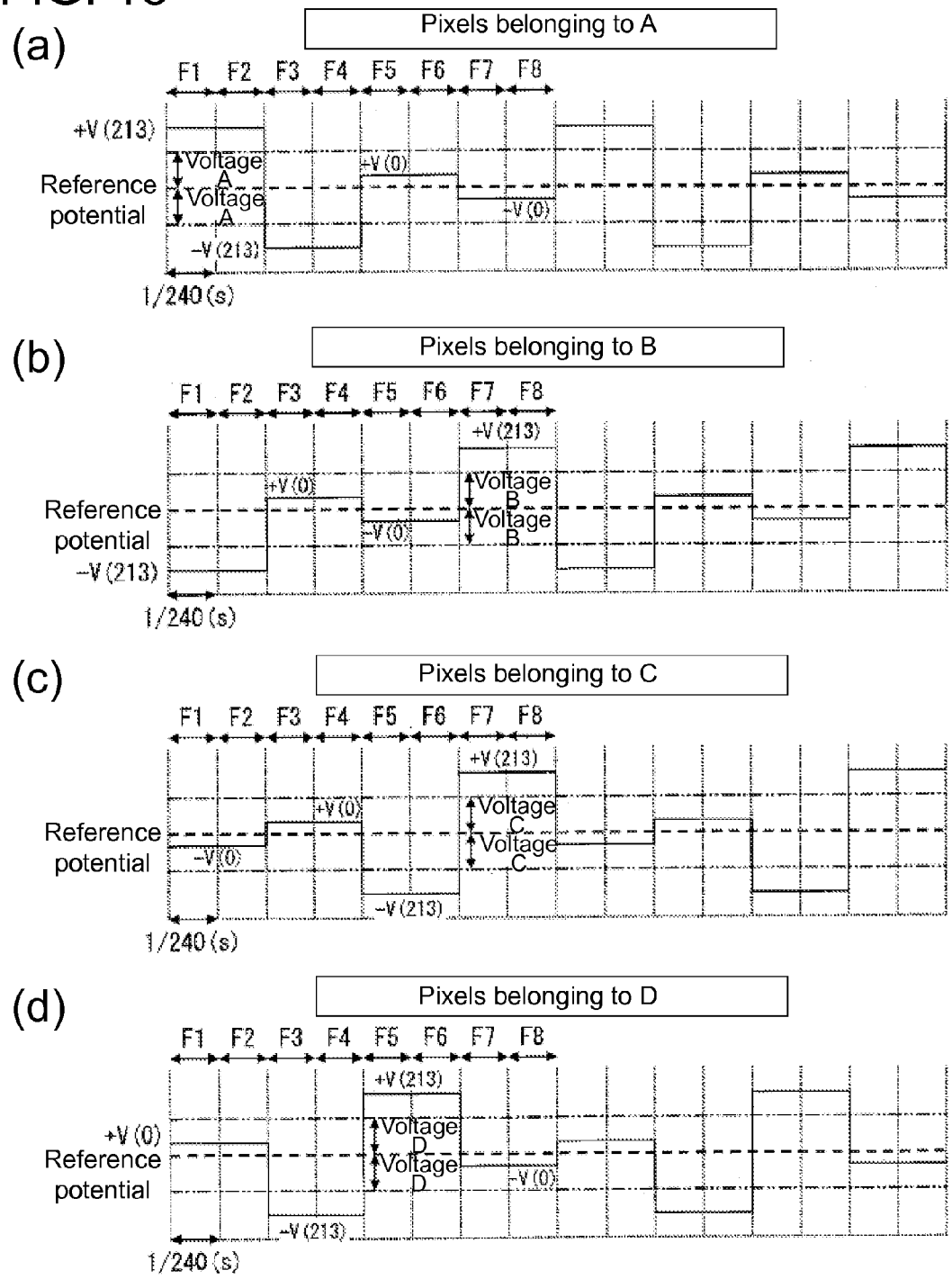
FIG. 18 schematically shows another example of the effective potential sequences providing the luminance variation patterns shown in FIG. 15.
Figure 19:
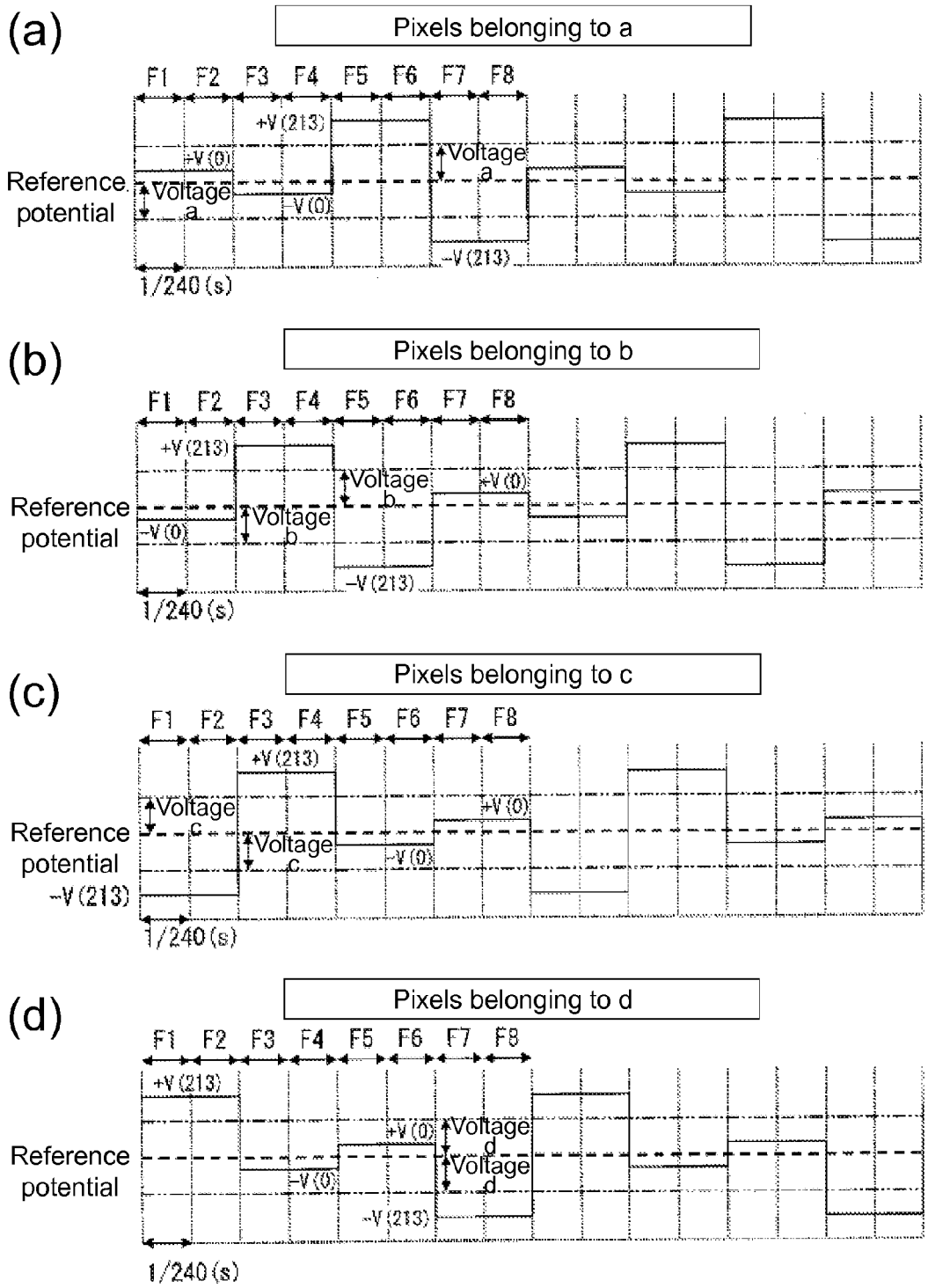
FIG. 19 schematically shows another example of the effective potential sequences providing the luminance variation patterns shown in FIG. 16.

In FIG. 13 and FIG. 14 show the case where effective potentials of the same polarity are applied on pixels during a cycle, and the effective potentials applied on two adjacent pixels are of the same polarity. However, the present invention is not limited to this. For example, as shown in FIG. 18 and FIG. 19, the polarity of the effective potential applied on pixels during a cycle (F1-F4) may be reversed for every frame, and the effective potentials for two adjacent pixels may have opposite polarities. Here, voltage A to voltage D of FIG. 18 and voltage a to voltage d of FIG. 19 each represents the potential difference between the effective potential corresponding to gradation 120 and the reference potential, and the reference potential represents the midpoint of the effective potential amplitude (Vcom, for example).

In this case, on pixels belonging to display unit A (type 1), as shown in FIG. 18(*a*), a positive effective potential +V(213) corresponding to gradation 213 is applied during each of the first frame F1 and the second frame F2; a negative effective potential −V(213) corresponding to gradation 213 is applied during each of the third frame F3 and the fourth frame F4; a positive effective potential +V(0) corresponding to gradation 0 is applied during each of the fifth frame F5 and the sixth frame F6; and a negative effective potential −V(0) corresponding to gradation 0 is applied during each of the seventh frame F7 and the eighth frame F8.

Here, a relation of the potential difference between +V(0) and the reference potential (effective voltage)=the potential difference between −V(0) and the reference potential (effective voltage)<voltage A<the potential difference between +V(213) and the reference potential (effective voltage)=the potential difference between −V(213) and the reference potential (effective voltage) is satisfied.

Also, on pixels belonging to display unit B (type 3), as shown in FIG. 18(*b*), a negative effective potential −V(213) corresponding to gradation 213 is applied during each of the first frame F1 and the second frame F2; a positive effective potential +V(0) corresponding to gradation 0 is applied during each of the third frame F3 and the fourth frame F4; a negative effective potential −V(0) corresponding to gradation 0 is applied during each of the fifth frame F5 and the sixth frame F6; and a positive effective potential +V(213) corresponding to gradation 213 is applied during each of the seventh frame F7 and the eighth frame F8.

Here, a relation of the potential difference between +V(0) and the reference potential (effective voltage)=the potential difference between −V(0) and the reference potential (effective voltage)<voltage B<the potential difference between +V(213) and the reference potential (effective voltage)=the potential difference between −V(213) and the reference potential (effective voltage) is satisfied.

Also, on pixels belonging to display unit C (type 2), as shown in FIG. 18(*c*), a negative effective potential −V(0) corresponding to gradation 0 is applied during each of the first frame F1 and the second frame F2; a positive effective potential +V(0) corresponding to gradation 0 is applied during each of the third frame F3 and the fourth frame F4; a negative effective potential −V(213) corresponding to gradation 213 is applied during each of the fifth frame F5 and the sixth frame F6; a positive effective potential +V(213) corresponding to gradation 213 is applied during each of the seventh frame F7 and the eighth frame F8.

Here, a relation of the potential difference between +V(0) and the reference potential (effective voltage)=the potential difference between −V(0) and the reference potential (effective voltage)<voltage C<the potential difference between +V(213) and the reference potential (effective voltage)=the potential difference between −V(213) and the reference potential (effective voltage) is satisfied.

Also, on pixels belonging to display unit D (type 4), as shown in FIG. 18(*d*), a positive effective potential +V(0) corresponding to gradation 0 is applied during each of the first frame F1 and the second frame F2; a negative effective potential −V(213) corresponding to gradation 213 is applied during each of the third frame F3 and the fourth frame F4; a positive effective potential +V(213) corresponding to gradation 213 is applied during each of the fifth frame F5 and the sixth frame F6; a negative effective potential −V(0) corresponding to gradation 0 is applied during each of the seventh frame F7 and the eighth frame F8.

Here, a relation of the potential difference between +V(0) and the reference potential (effective voltage)=the potential difference between −V(0) and the reference potential (effective voltage)<voltage D<the potential difference between +V(213) and the reference potential (effective voltage)=the potential difference between −V(213) and the reference potential (effective voltage) is satisfied.

Further, on pixels belonging to display unit a (type 2), as shown in FIG. 19(*a*), a positive effective potential +V(0) corresponding to gradation 0 is applied during each of the first frame F1 and the second frame F2; a negative effective potential −V(0) corresponding to gradation 0 is applied during each of the third frame F3 and the fourth frame F4; a positive effective potential +V(213) corresponding to gradation 213 is applied during each of the fifth frame F5 and the sixth frame F6; a negative effective potential −V(213) corresponding to gradation 213 is applied during each of the seventh frame F7 and the eighth frame F8.

Here, a relation of the potential difference between +V(0) and the reference potential (effective voltage)=the potential difference between −V(0) and the reference potential (effective voltage)<voltage a<the potential difference between +V(213) and the reference potential (effective voltage)=the potential difference between −V(213) and the reference potential (effective voltage) is satisfied.

Also, on pixels belonging to display unit b (type 4), as shown in FIG. 19(*b*), a negative effective potential −V(0) corresponding gradation 0 is applied during each of the first frame F1 and the second frame F2; a positive effective potential +V(213) corresponding to gradation 213 is applied during each of the third frame F3 and the fourth frame F4; a negative effective potential −V(213) corresponding to gradation 213 is applied during each of the fifth frame F5 and the sixth frame F6; and a positive effective potential +V(0) corresponding to gradation 0 is applied during each of the seventh frame F7 and the eighth frame F8.

Here, a relation of the potential difference between +V(0) and the reference potential (effective voltage)=the potential difference between −V(0) and the reference potential (effective voltage)<voltage b<the potential difference between +V(213) and the reference potential (effective voltage)=the potential difference between −V(213) and the reference potential (effective voltage) is satisfied.

Also, on pixels belonging to display unit c (type 1), as shown in FIG. 19(*c*), a negative effective potential −V(213) corresponding to gradation 213 is applied during each of the first frame F1 and the second frame F2; a positive effective potential +V(213) corresponding to gradation 213 is applied during each of the third frame F3 and the fourth frame F4; a negative effective potential −V(0) corresponding to gradation 0 is applied during each of the fifth frame F5 and the sixth frame F6; and a positive effective potential +V(0) corresponding to gradation 0 is applied during each of the seventh frame F7 and the eighth frame F8.

Here, a relation of the potential difference between +V(0) and the reference potential (effective voltage)=the potential difference between −V(0) and the reference potential (effective voltage)<voltage c<the potential difference between +V(213) and the reference potential (effective voltage)=the potential difference between −V(213) and the reference potential (effective voltage) is satisfied.

Also, on pixels belonging to display unit d (type 3), as shown in FIG. 19(*d*), a positive effective potential +V(213) corresponding to gradation 213 is applied during each of the first frame F1 and the second frame F2; a negative effective potential −V(0) corresponding to gradation 0 is applied during each of the third frame F3 and the fourth frame F4; a positive effective potential +V(0) corresponding to gradation 0 is applied during each of the fifth frame F5 and the sixth frame F6; and a negative effective potential −V(213) corresponding to gradation 213 is applied during each of the seventh frame F7 and the eighth frame F8.

Here, a relation of the potential difference between +V(0) and the reference potential (effective voltage)=the potential difference between −V(0) and the reference potential (effective voltage)<voltage d<the potential difference between +V(213) and the reference potential (effective voltage)=the potential difference between −V(213) and the reference potential (effective voltage) is satisfied.

Here, as a result of the driving as shown in FIG. 18(*a*) to FIG. 18(*d*), the luminance (transmission) of pixels belonging to display unit A (type 1) changes following the pattern shown in FIG. 15(*a*) during the first frame F1 to the eighth frame F8; the luminance (transmission) of pixels belonging to display unit B (type 3) changes following the pattern shown in FIG. 15(*b*) during the first frame F1 to the eighth frame F8; the luminance (transmission) of pixels belonging to display unit C (type 2) changes following the pattern shown in FIG. 15(*c*) during the first frame F1 to the eighth frame F8; and the luminance (transmission) of pixels belonging to display unit D (type 4) changes following the pattern shown in FIG. 15(*d*) during the first frame F1 to the eighth frame F8.

Also, as a result of the driving as shown in FIG. 19(*a*) to FIG. 19(*d*), the luminance (transmission) of pixels belonging to display unit a (type 2) changes following the pattern shown in FIG. 16(*a*) during the first frame F1 to the eighth frame F8; the luminance (transmission) of display unit b (type 4) changes following the pattern shown in FIG. 16(*b*) during the first frame F1 to the eighth frame F8; the luminance (transmission) of pixels belonging to display unit c (type 1) changes following the pattern shown in FIG. 16(*c*) during the first frame F1 to the eighth frame F8; and the luminance (transmission) of pixels belonging to display unit d (type 3) changes following the pattern shown in FIG. 16(*d*) during the first frame F1 to the eighth frame F8.

In the present liquid crystal display device, as shown in FIG. 2 and FIGS. 6 to 19, preferably a display unit composed of type 1 pixels and a display unit imposed of type 3 pixels are disposed adjacent to each other in the row direction; a display unit composed of type 3 pixels and a display unit composed of type 2 pixels are disposed adjacent to each other in the row direction; a display unit composed of type 2 pixels and a display unit composed of type 4 pixels are disposed adjacent to each other in the row direction; and a display unit composed of type 4 and a display unit composed of type 1 pixels are disposed adjacent to each other in the row direction.

Further, preferably, a display unit composed of type 1 pixels and a display unit composed of type 2 pixels are disposed adjacent to each other in the column direction; and a display unit composed of type 3 pixels and a display unit composed of type 4 pixels are disposed adjacent to each other. This way, the motion picture display quality can be improved.

Figure 20:
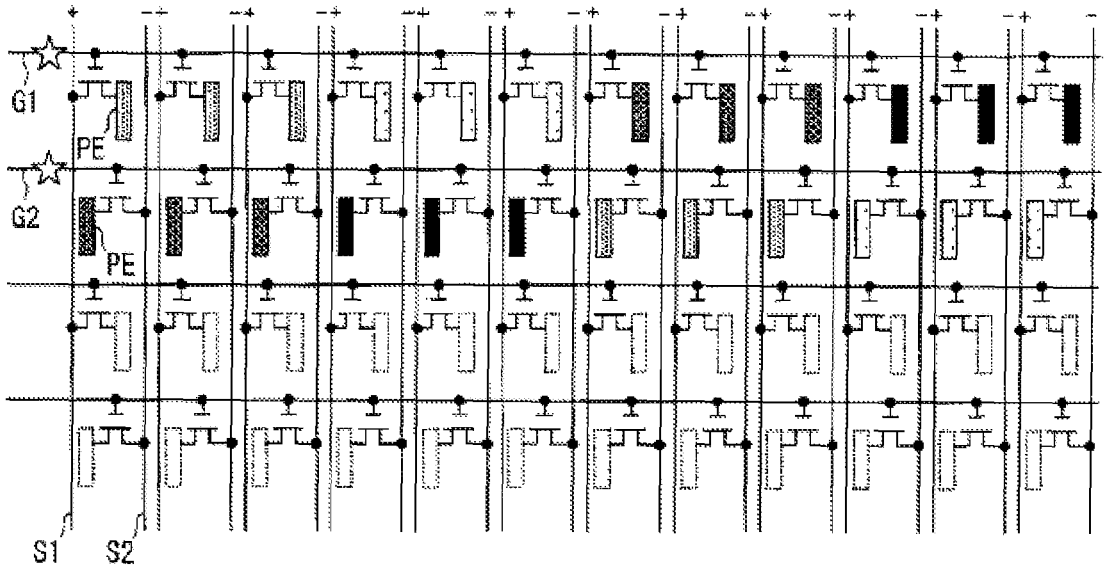
FIG. 20 schematically shows a configuration and a driving method of a liquid crystal panel used in the present liquid crystal display device.
Figure 20:
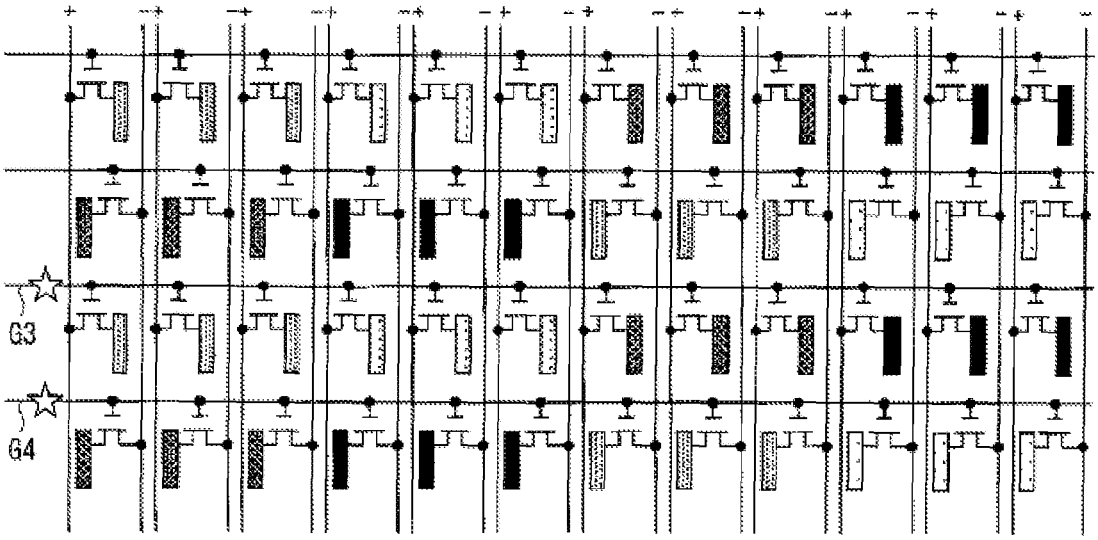

FIG. 20 schematically shows the configuration of a liquid crystal panel in the present liquid crystal display device and an example of driving the liquid crystal panel. In the present liquid crystal panel, two data signal lines S1 and S21 are provided for each column of pixels, and the pixel electrode included in one of the two pixels disposed adjacent to each other in the same column of pixels and the pixel electrode included in the other of the pixels are connected to different data signal lines through transistors. Two scan signal lines are selected at a time, and effective potentials having opposite polarities are applied on the respective two data signal lines S1 and S2 for each column of pixels. For example, in FIG. 20(*a*) (corresponding to the first frame F1 of FIG. 10), scan signal lines G1 and G2 are selected, and on each of the pixel electrodes PE connected to the scan signal line G1 and the data signal line S1 through transistors, a positive effective potential (the potential difference between this effective potential and the reference potential is called effective voltage) is written, and on each of the pixel electrodes PE connected to the scan signal line G2 and the data signal line S2 through transistors, a negative effective potential (the potential difference between this effective potential and the reference potential is called effective voltage) is written. Also, in FIG. 20(*b*) (this corresponds to the first frame F1 of FIG. 10), which illustrates a view 1H (horizontal scan period) after the FIG. 20(*a*), scan signal lines G3 and G4 are selected, and on each of the pixel electrodes PE connected to the scan signal line G3 and the data signal line S1 through transistors, a positive effective potential (the potential difference between this effective potential and the reference potential is called effective voltage) is written, and on each of the pixel electrodes PE connected to the scan signal line G4 and the data signal line S2 through transistors, a negative effective potential (the potential difference between this effective potential and the reference potential is called effective voltage) is written.

In order to display a same halftone continuously, the present liquid crystal display device only needs to have: a type 1 pixel that rises during the first term, rises or stays on hold during the second term, decays during the third term, and decays or stays on hold during the fourth term; a type 2 pixel that decays during the first term, decays or stays on hold during the second term, rises during the third term, and rises or stays on hold during the fourth term; a type 3 pixel that rises or stays on hold during the first term, decays during the second term, decays or stays on hold during the third term; and rises during the fourth term; and a type 4 pixel that decays or stays on hold during the first term, rises during the second term, rises or stays on hold during the third term, and decays during the fourth term. The waveform of the luminance variations of pixels of respective types is not limited to trapezoidal as the case with Embodiments 1 and 2.

Figure 21:
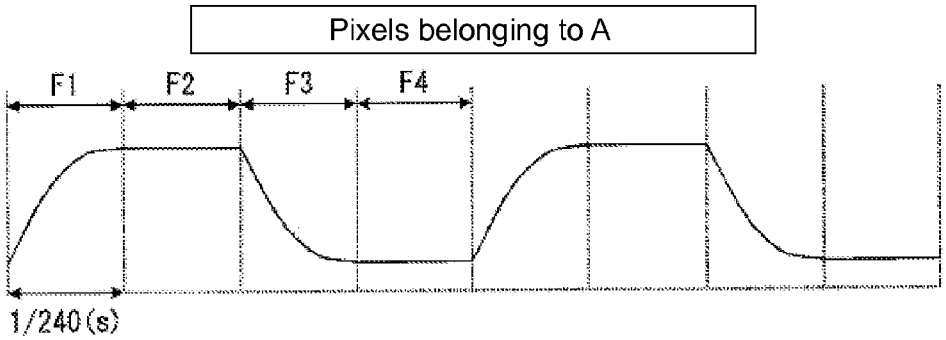
FIG. 21 schematically shows another example of luminance variations at pixels belonging to respective display units A to D.
Figure 21:
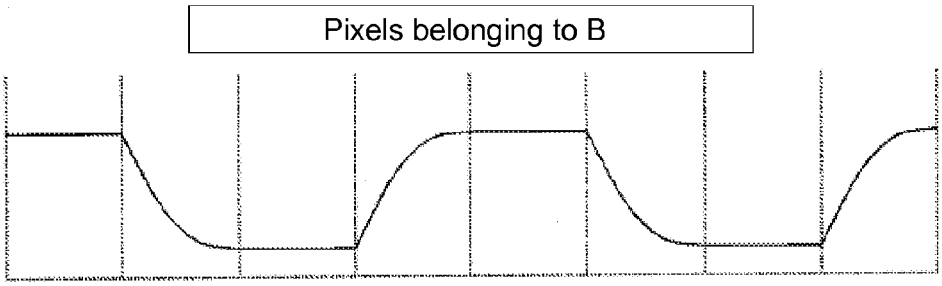
Figure 21:
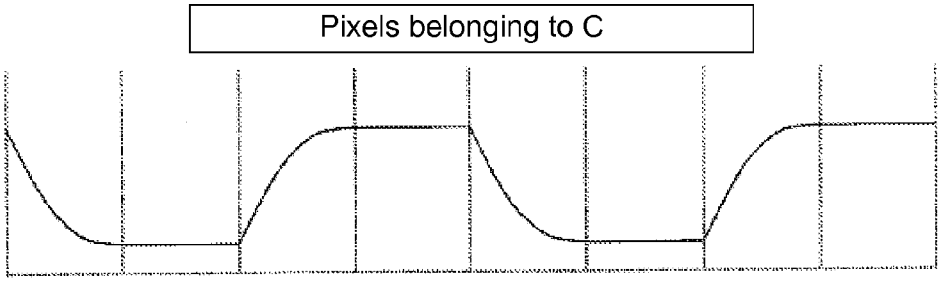
Figure 21:
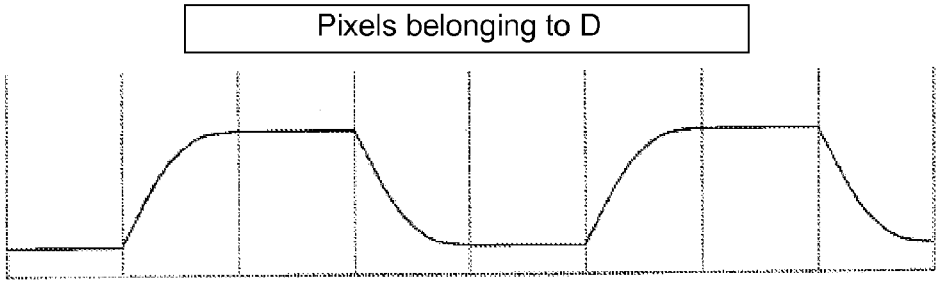

For example, as shown in FIG. 21, the luminance variation waveform of each pixel may be rectangular. In this case, pixels included in A rise during the first term (F1), stay on hold during the second term (F2), decay during the third term (F3), and stay on hold during the fourth term (F4); pixels included in C decay during the first term (F1), stay on hold during the second term (F2), rise during the third term (F3), and stay on hold during the fourth term (F4); pixels included in B stay on hold during the first term (F1), decay during the second term (F2), stay on hold during the third term (F3), and rise during the fourth term (F4); and pixels included in D stay on hold during the first term (F1), rise during the second term (F2), stay on hold during the third term (F3), and decay during the fourth term (F4). In FIG. 21, a cycle is composed of four frames. However, a cycle may be an eight-frame period, and a term may be a two-frame period. In the case of the rectangular waveform as shown in FIG. 21, the effective voltage to be applied on pixels (i.e., signal potential supplied to the pixels) during each frame may be set in consideration of the number of frame periods in a term, the frame frequency, display gradation, liquid crystal characteristics, and the like, so that the amount of the luminance change in a cycle is increased (to improve the viewing angle characteristics). In FIG. 21, the frame frequency is 240 Hz (quadruple speed).

Figure 22:
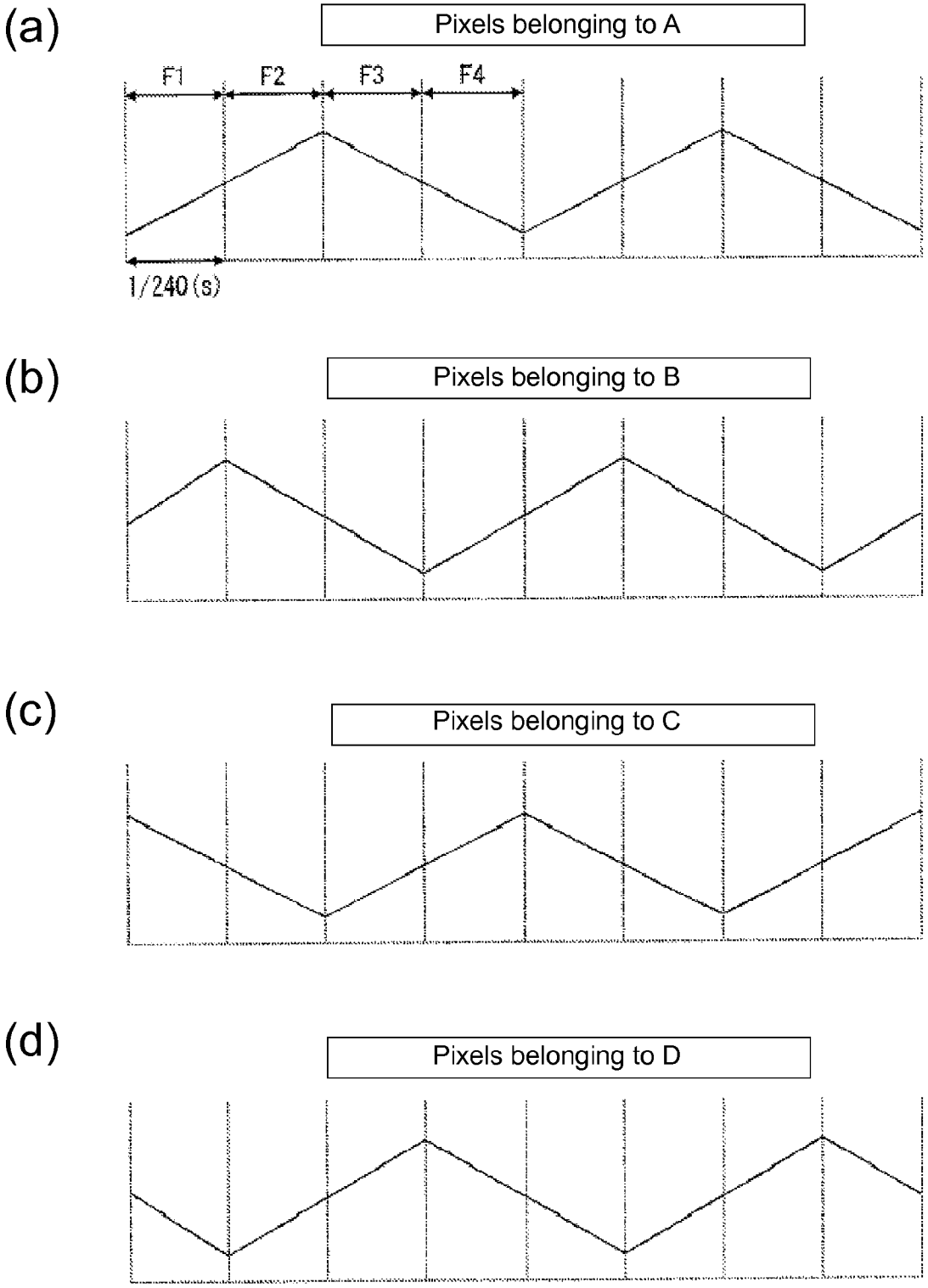
FIG. 22 schematically shows yet another example of luminance variations at pixels belonging to respective display units A to D.

Also, as shown in FIG. 22, the luminance variation waveform of each pixel may be triangular. In this case, pixels included in A rise during the first term (F1), rise during the second term (F2), decay during the third term (F3), and decay during the fourth term (F4); pixels included in C decay during the first term (F1), decay during the second term (F2), rise during the third term (F3), and rise during the fourth term (F4); pixels included in B rise during the first term (F1), decay during the second term (F2), decay during the third term (F3), and rise during the fourth term (F4); and pixels included in D decay during the first term (F1), rise during the second term (F2), rise during the third term (F3), and decay during the fourth term (F4). In FIG. 22, a cycle is composed of four frames, but a cycle may be an eight-frame period and a term may be a two-frame period. In the case of the triangular waveform as shown in FIG. 22, the effective voltage to be applied on pixels (i.e., signal potential supplied to the pixels) during each frame may be set in consideration of the number of frame periods in a term, frame frequency, display gradation, liquid crystal characteristics, and the like, so that the amount of the luminance change is increased (to improve the viewing angle characteristics). In FIG. 22, the frame frequency is also 240 Hz (quadruple speed).

The present liquid crystal display device may also be configured such that writing to each of the n pixels (n is an integer of at least 3) is conducted one frame period after any previous writing to the same pixel, and that, with one term composed of a single frame or a plurality of frames and one cycle composed of a first to nth terms, the luminance levels of the individual n pixels change differently from one another during each of the first to the nth terms when data that corresponds to a halftone and sets the average luminance in a cycle of each of the n pixels to an equal level is continuously displayed. As a result of this configuration, the flicker frequency can be increased (to the level unrecognizable to human eyes).

For example, FIG. 8(*a*) to FIG. 8(*d*) show changes in luminance of four pixels (a pixel belonging to A, a pixel belonging to B, a pixel belonging to C, and a pixel belonging to D) when data that corresponds to a halftone and sets the average luminance in a cycle of each of the pixels to an equal level is continuously displayed, where a term is composed of one frame and a cycle is composed of the first term to the fourth term. In FIG. 8(*a*) to FIG. 8(*d*), the luminance levels of the four pixels change differently during the first term (F1) (the luminance rises at the pixel belonging to A, rises and then stays on hold at the pixel belonging to B, decays at the pixel C, and stays on hold at the pixel belonging to D); the luminance levels of the four pixels change differently also during the second term (F2) (the luminance at the pixel belonging to A rises and then stays on hold, decays at the pixel belonging to B, stays on hold at pixel belonging to C, and rises at pixels belonging to D); the luminance levels of the four pixels change differently also during the third term (F3) (the luminance decays at the pixel belonging to A, stays on hold at the pixel belonging to B, rises at the pixel belonging to C, and rises and then stays on hold at the pixel belonging to D); and the luminance levels of the four pixels change differently also during the fourth term (F4) (the luminance stays on hold at the pixel belonging to A, rises at the pixel belonging to B, rises and then stays on hold at the pixel belonging to C, and decays at the pixel belonging to D).

Figure 23:
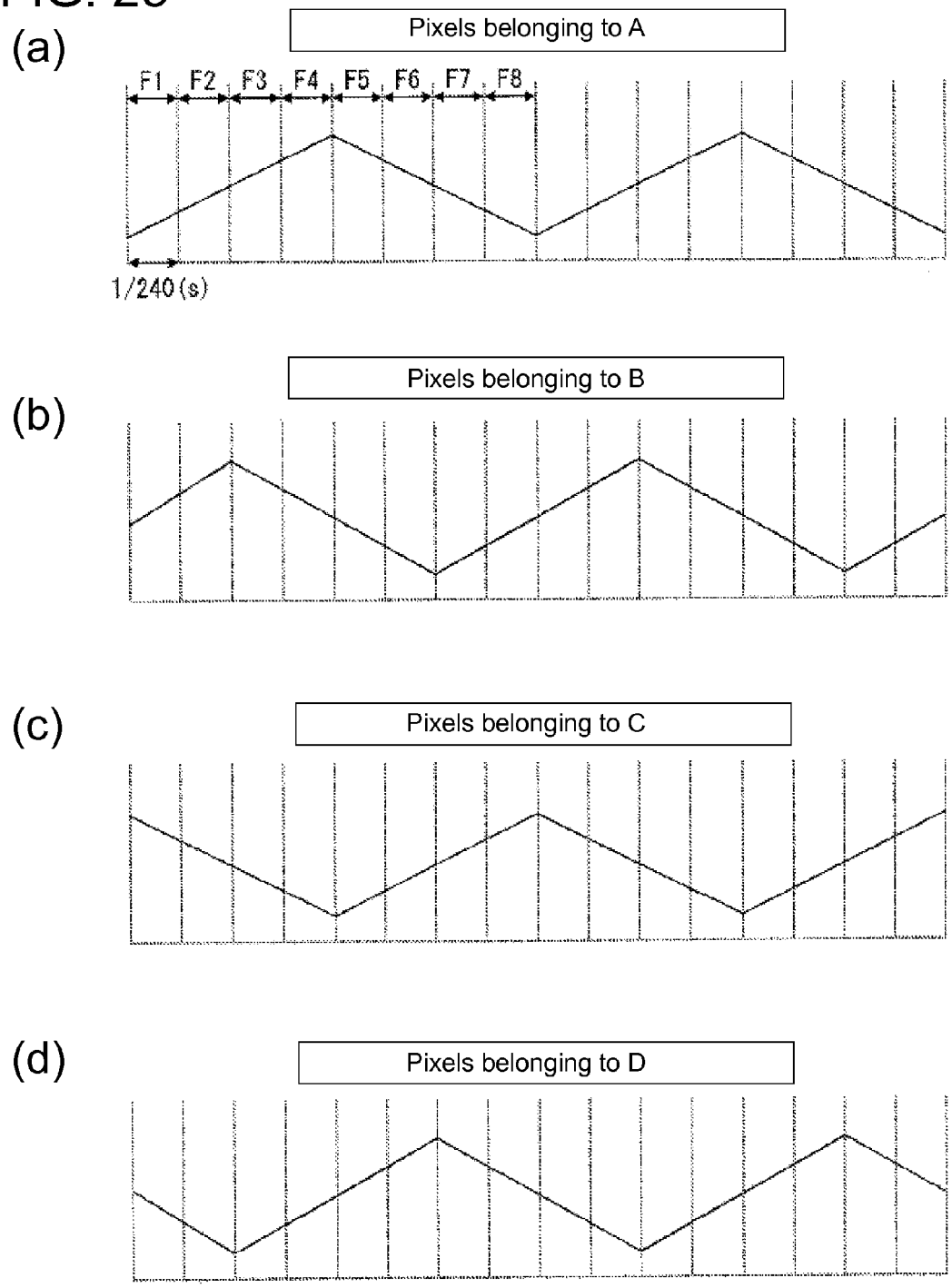
FIG. 23 schematically shows yet another example of luminance variations at pixels belonging to display units A to D.
Figure 24:
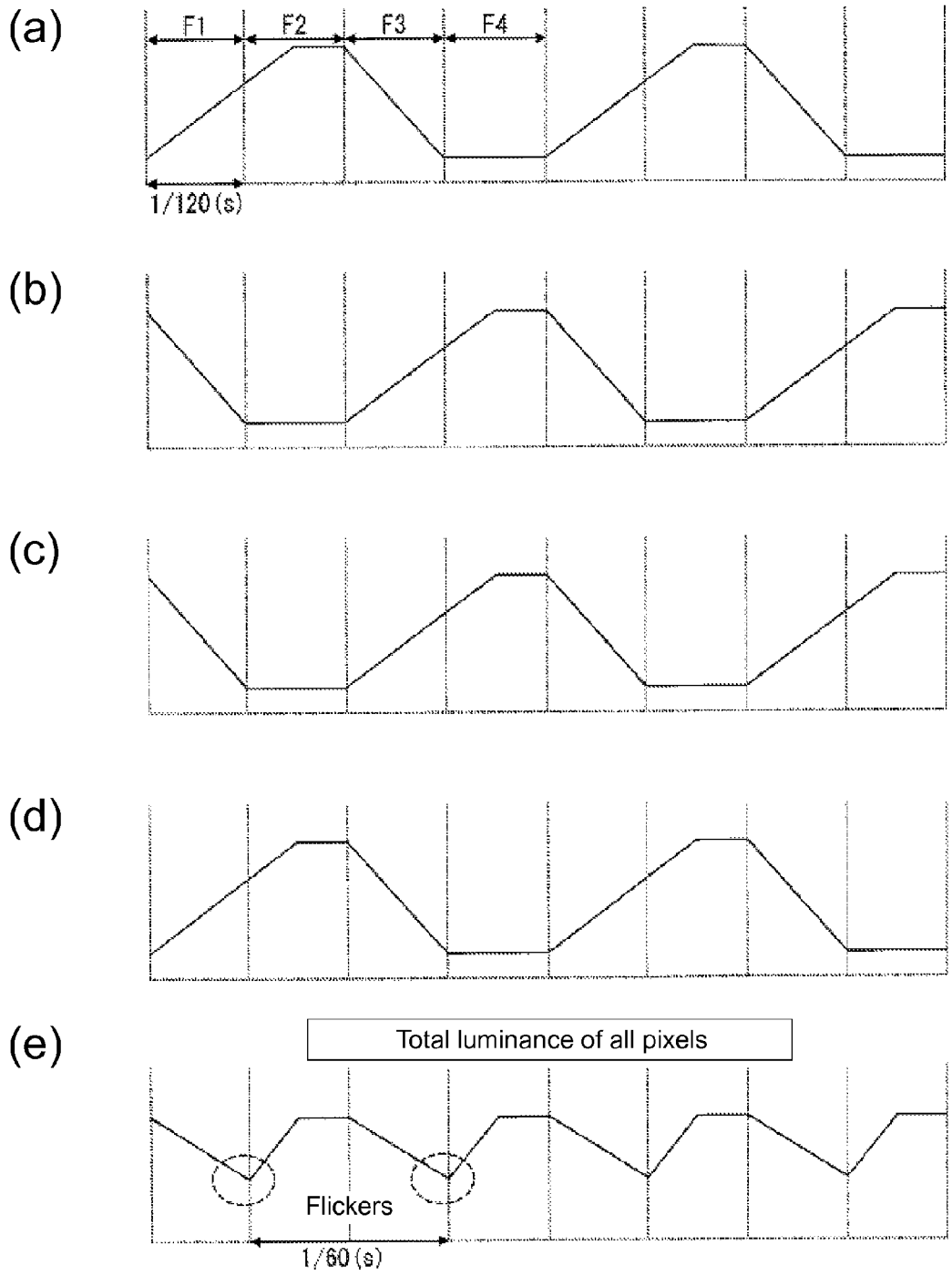
FIG. 24 schematically shows the luminance variation pattern and flicker occurrences at pixels belonging to respective four display units when a conventional driving is conducted.

Also, for example, FIG. 23(*a*) to FIG. 23(*d*) show changes in luminance of four pixels (a pixel belonging to A, a pixel belonging to B, a pixel belonging to C, and a pixel belonging to D) when data that corresponds to a halftone and sets the average luminance in a cycle of each of the pixels to an equal level is displayed continuously, where a term is composed of two frames and the first to the fourth terms constitute a cycle. In FIG. 23(*a*) to FIG. 23(*d*), the luminance levels of the four pixels change differently during the first term (F1 and F2) (the luminance rises from low to middle (average luminance) at the pixel belonging to A, rises from middle (average luminance) to high at the pixel belonging to B, decays from high to middle (average luminance) at the pixel belonging to C, and decays from middle (average luminance) to low at the pixel belonging to D); the luminance levels of the four pixels change differently also during the second term (F3 and F4) (the luminance rises from the middle (average luminance) to high at the pixel belonging to A, decays from high to middle (average luminance) at the pixel belonging to B, decays from middle (average luminance) to low at the pixel belonging to C, and rises from low to middle (average luminance) at the pixel belonging to D); the luminance levels of the four pixels change differently also during the third term (F5 and F6) (the luminance decays from high to middle (average luminance) at the pixel belonging to A, decays from middle (average luminance) to low at the pixel belonging to B, rises from low to middle (average luminance) at the pixel belonging to C, and rises from middle (average luminance) to high at the pixel belonging to D); the luminance levels of the four pixels change differently also during the fourth term (F7 and F8) (the luminance decays from middle (average luminance) to low at the pixel belonging to A, rises from low to middle (average luminance) at the pixel belonging to B, rises from middle (average luminance) to high at the pixel belonging to C, and decays from high to middle (average luminance) at the pixel belonging to D).

The present invention is not limited to the embodiments described above. Any appropriate modifications of the embodiments described above based on the common technical knowledge, and any combinations of them are also included in embodiments of the present invention.

INDUSTRIAL APPLICABILITY

The present liquid crystal display device is suitable for liquid crystal television, for example.

DESCRIPTION OF REFERENCE CHARACTERS

F1-F8 first frame-eighth frame
A-D, a-d display unit
LUT1 look-up table
LUT2 look-up table
G1-G4 scan signal line
S1, S2 data signal line

The invention claimed is:

1. A liquid crystal display device, comprising:

a liquid crystal panel having a plurality of pixels arranged in a matrix, said plurality of pixels being grouped into four types of type 1, type 2, type 3, and type 4;

a panel driver circuit connected to the liquid crystal panel to drive the liquid crystal panel; and a display control circuit connected to the panel driver circuit, said display control circuit receiving an image signal, wherein said display control circuit divides each refresh cycle of the image signal into consecutive first to fourth terms and causes the panel driver circuit to drive the liquid crystal panel to perform a halftone display by changing pixel luminance during each refresh cycle composed of the first to fourth terms, and wherein said display control circuit provides timing signals and gradation data to the panel driver circuit so that, for a given halftone to be displayed in a refresh cycle, pixels belonging to respective types in the liquid crystal panel are driven such that:

on pixels in type 1, an effective voltage that is at least as high as a first voltage is applied during the first and second terms, while an effective voltage that is lower than the first voltage is applied during the third and fourth terms, thereby generating the halftone as averaged over the first to fourth terms;

on pixels in type 2, an effective voltage that is lower than a second voltage is applied during the first and second terms, while an effective voltage that is at least as high as the second voltage is applied during the third and fourth terms, thereby generating the halftone as averaged over the first to fourth terms;

on pixels in type 3, an effective voltage that is lower than a third voltage is applied during the second and third terms, while an effective voltage that is at least as high as the third voltage is applied at least during the first term or the fourth term, thereby generating the halftone as averaged over the first to fourth terms; and on pixels in type 4, an effective voltage of at least as high as a fourth voltage is applied during each of the second and third terms, while an effective voltage lower than the fourth voltage is applied at least during the first term or the fourth term, thereby generating the halftone as averaged over the first to fourth terms.

2. The liquid crystal display device according to claim 1, wherein the refresh cycle is a four-frame period and each term is a one-frame period, or the refresh cycle is an eight-frame period and each term is a two-frame period.

3. The liquid crystal display device according to claim 1, wherein the liquid crystal panel is configured such that two pixels disposed adjacent to each other in a scan direction are of different types.

4. The liquid crystal display device according to claim 1, wherein the liquid crystal panel is configured such that two pixels arranged in a scan direction with another pixel disposed in between are of the same type.

5. The liquid crystal display device according to claim 1, wherein the liquid crystal panel has a plurality of display units, each of the display units being composed of a plurality of pixels of different colors, said plurality of display units are arranged in row and column directions, and the plurality of pixels included in each of the display units are of the same type.

6. The liquid crystal display device according to claim 5, wherein a scan direction of the liquid crystal panel is the column direction, a display unit composed of type 1 pixels and a display unit composed of type 3 pixels are disposed adjacent to each other in the row direction, a display unit composed of type 3 pixels and a display unit composed of type 2 pixels are disposed adjacent to each other in the row direction, a display unit composed of type 2 pixels and a display unit composed of type 4 pixels are disposed adjacent to each other in the row direction, and a display unit composed of type 4 pixels and a display unit composed of type 1 pixels are disposed adjacent to each other in the row direction.

7. The liquid crystal display device according to claim 6, wherein a display unit composed of type 1 pixels and a display unit composed of type 2 pixels are disposed adjacent to each other in the column direction, and a display unit composed of type 3 pixels and a display unit composed of type 4 pixels are disposed adjacent to each other in the column direction.

8. The liquid crystal display device according to claim 5, wherein each of the display units is composed of a red pixel, a green pixel, and a blue pixel.

9. The liquid crystal display device according to claim 5, wherein a total number of display units composed of type 1 pixels, a total number of display units composed of type 2 pixels, a total number of display units composed of type 3 pixels, and a total number of display units composed of type 4 pixels are substantially equal.

10. The liquid crystal display device according to claim 1, wherein a frame frequency is at least 75 Hz.

11. The liquid crystal display device according to claim 1, wherein a scan direction of the liquid crystal panel is defined as a column direction, two data signal lines are provided for each column of pixels, two pixels disposed adjacent to each other in the column direction are connected to respective data signal lines through transistors, and two scan signal lines are selected at a time.

12. The liquid crystal display device according to claim 11, wherein two data lines provided for each column of pixels receive respective signal potentials, which are of opposite polarities.

13. A television receiver comprising the liquid crystal display device according to claim 1 and a tuner unit receiving television broadcasting.

14. A display method of a liquid crystal display device including a liquid crystal panel that has a plurality of pixels arranged in a matrix, said plurality of pixels being grouped into four types of type 1, type 2, type 3, type 4, the method comprising;

receiving an image signal to be displayed;

dividing each refresh cycle of the image signal into consecutive first to fourth terms; and driving the liquid crystal panel to display a halftone display by changing pixel luminance of the pixels during each refresh cycle composed of the first to fourth terms, the driving of the liquid crystal panel includes;

on pixels in type 1, applying an effective voltage that is at least as high as a first voltage during the first and second terms, while applying an effective voltage that is lower than the first voltage during the third and fourth terms, thereby generating the halftone as averaged over the first to fourth terms;

on pixels in type 2, applying an effective voltage that is lower than a second voltage during the first and second terms, while applying an effective voltage that is at least as high as the second voltage during the third and fourth terms, thereby generating the halftone as averaged over the first to fourth terms;

on pixels in type 3, applying an effective voltage that is lower than a third voltage during the second and third terms, while applying an effective voltage that is at least as high as the third voltage at least during the first term or the fourth term, thereby generating the halftone as averaged over the first to fourth terms; and on pixels in type 4, applying an effective voltage of at least as high as a fourth voltage during each of the second and third terms, while applying an effective voltage lower than the fourth voltage at least during the first term or the fourth term, thereby generating the halftone as averaged over the first to fourth terms.

* * * * *